US010434380B2

(12) United States Patent
Kawaguchi

(10) Patent No.: US 10,434,380 B2
(45) Date of Patent: Oct. 8, 2019

(54) MULTI-MATERIAL GOLF CLUB HEAD

(71) Applicant: Acushnet Company, Fairhaven, MA (US)

(72) Inventor: Hiroshi Kawaguchi, Aliso Viejo, CA (US)

(73) Assignee: Acushnet Company, Faihaven, MA (US)

( * ) Notice: Subject to any disclaimer, the term of this patent is extended or adjusted under 35 U.S.C. 154(b) by 195 days.

(21) Appl. No.: 15/721,142

(22) Filed: Sep. 29, 2017

(65) Prior Publication Data

US 2018/0085644 A1 Mar. 29, 2018

Related U.S. Application Data

(63) Continuation-in-part of application No. 15/204,736, filed on Jul. 7, 2016, which is a continuation-in-part of application No. 15/047,975, filed on Feb. 19, 2016, now Pat. No. 10,232,230, which is a continuation-in-part of application No. 14/945,243, filed on Nov. 18, 2015, now Pat. No. 10,065,084.

(51) Int. Cl.

| | |
|---|---|
| ***A63B 53/04*** | (2015.01) |
| ***A63B 60/52*** | (2015.01) |
| ***A63B 60/50*** | (2015.01) |
| *A63B 60/00* | (2015.01) |

(52) U.S. Cl.

CPC ..... *A63B 53/0466* (2013.01); *A63B 60/50* (2015.10); *A63B 60/52* (2015.10); *A63B 2053/0408* (2013.01); *A63B 2053/0433* (2013.01); *A63B 2053/0437* (2013.01); *A63B 2060/002* (2015.10); *A63B 2209/00* (2013.01); *A63B 2209/02* (2013.01)

(58) Field of Classification Search

CPC ..... A63B 53/0466; A63B 60/52; A63B 60/50; A63B 2209/00; A63B 2060/002; A63B 2209/02; A63B 2053/0408; A63B 2053/0433; A63B 2053/0437

USPC ..... 473/324, 345, 346, 347, 348, 349

See application file for complete search history.

(56) References Cited

U.S. PATENT DOCUMENTS

| | | |
|---|---|---|
| 4,076,254 A | 2/1978 | Nygren |
| 4,139,196 A | 2/1979 | Riley |

(Continued)

FOREIGN PATENT DOCUMENTS

| | | |
|---|---|---|
| GB | 2450764 | 7/2009 |
| JP | H05-7261 | 2/1993 |

(Continued)

OTHER PUBLICATIONS

U.S. Appl. No. 15/017,312, filed Feb. 5, 2016, Myrhum et al.

(Continued)

*Primary Examiner* — Nini F Legesse
(74) *Attorney, Agent, or Firm* — Randy K. Chang

(57) ABSTRACT

A golf club head made out of multi-material is disclosed herein. More specifically, the golf club head in accordance with the present invention has at least a portion of the body of the golf club head that is further comprised out of a base layer and a lightweight cover layer. The base layer may have a plurality of cutouts to help reduce unnecessary mass and the lightweight cover layer may be made out of an ultra-lightweight material to further reduce the unnecessary mass.

20 Claims, 18 Drawing Sheets

(56) References Cited

U.S. PATENT DOCUMENTS

| | | | | |
|---|---|---|---|---|
| 4,229,550 | A | 10/1980 | Jones et al. | |
| 4,448,941 | A | 5/1984 | Cheung et al. | |
| 4,681,322 | A | 7/1987 | Straza et al. | |
| 5,058,895 | A | 10/1991 | Igarashi | |
| 5,132,178 | A | 7/1992 | Chyung et al. | |
| 5,163,682 | A | 11/1992 | Schmidt et al. | |
| 5,238,529 | A | 8/1993 | Douglas | |
| 5,295,689 | A | 3/1994 | Lundberg | |
| 5,310,185 | A | 5/1994 | Viollaz et al. | |
| 5,346,216 | A | 9/1994 | Aizawa | |
| 5,358,249 | A | 10/1994 | Mendralla | |
| 5,362,055 | A | 11/1994 | Rennie | |
| 5,380,010 | A | 1/1995 | Werner | |
| 5,403,007 | A | 4/1995 | Chen | |
| 5,405,136 | A | 4/1995 | Hardman | |
| 5,425,538 | A | 6/1995 | Vincent et al. | |
| 5,499,814 | A | 3/1996 | Lu | |
| 5,524,331 | A | 6/1996 | Pond | |
| 5,547,427 | A | 8/1996 | Rigal | |
| 5,570,886 | A | 11/1996 | Rigal | |
| 5,624,331 | A | 4/1997 | Lo | |
| 5,720,673 | A | 2/1998 | Anderson | |
| 5,743,813 | A | 4/1998 | Chen et al. | |
| 5,839,975 | A | 11/1998 | Lundberg | |
| 5,941,782 | A | 8/1999 | Cook | |
| 5,967,903 | A | 10/1999 | Cheng | |
| 5,997,415 | A * | 12/1999 | Wood | A63B 53/04 473/346 |
| 6,152,833 | A | 1/2000 | Werner | |
| 6,440,008 | B2 | 8/2002 | Murphy et al. | |
| 6,533,681 | B2 | 3/2003 | Inoue et al. | |
| 6,558,271 | B1 | 5/2003 | Beach | |
| 6,605,007 | B1 | 8/2003 | Bissonnette et al. | |
| 6,617,013 | B2 | 9/2003 | Morrison et al. | |
| 6,623,543 | B1 | 9/2003 | Zeller et al. | |
| 6,837,094 | B2 | 1/2005 | Pringle et al. | |
| 6,860,824 | B2 | 3/2005 | Evans | |
| 6,945,876 | B2 | 9/2005 | Nakahara et al. | |
| 7,037,214 | B2 | 5/2006 | Nakahara et al. | |
| 7,056,229 | B2 | 6/2006 | Chen | |
| 7,074,136 | B2 | 7/2006 | Noguchi et al. | |
| 7,108,614 | B2 | 9/2006 | Lo | |
| 7,140,974 | B2 | 11/2006 | Chao et al. | |
| 7,258,624 | B2 | 8/2007 | Kobayashi | |
| 7,267,620 | B2 | 9/2007 | Chao et al. | |
| 7,281,991 | B2 | 10/2007 | Gilbert et al. | |
| 7,281,994 | B2 | 10/2007 | De Shiell et al. | |
| 7,331,877 | B2 | 2/2008 | Yamaguchi et al. | |
| 7,347,796 | B2 | 3/2008 | Takeda | |
| 7,361,100 | B1 | 4/2008 | Morales | |
| 7,422,528 | B2 | 9/2008 | Gibbs et al. | |
| 7,448,964 | B2 | 11/2008 | Schweigert | |
| 7,510,485 | B2 | 3/2009 | Yamamoto | |
| 7,510,486 | B2 | 3/2009 | Werner | |
| 7,628,712 | B2 | 12/2009 | Chao et al. | |
| 7,632,193 | B2 | 12/2009 | Thielen | |
| 7,632,195 | B2 | 12/2009 | Jorgensen | |
| 7,686,708 | B2 | 3/2010 | Morales | |
| 7,798,203 | B2 | 9/2010 | Schweigert | |
| 7,861,395 | B2 | 1/2011 | Jorgensen | |
| 7,867,612 | B2 | 1/2011 | Schwung et al. | |
| 7,931,546 | B2 | 4/2011 | Bennett et al. | |
| 7,993,216 | B2 | 8/2011 | Lee | |
| 8,096,896 | B2 | 1/2012 | De Schiell | |
| 8,172,697 | B2 | 5/2012 | Cackett | |
| 8,221,261 | B2 | 7/2012 | Curtis et al. | |
| 8,247,062 | B2 | 8/2012 | Morrison et al. | |
| 8,293,356 | B2 | 10/2012 | Merrill et al. | |
| 8,419,569 | B2 | 4/2013 | Bennett et al. | |
| 8,475,292 | B2 | 7/2013 | Rahrig et al. | |
| 8,496,542 | B2 | 7/2013 | Curtis et al. | |
| 8,517,859 | B2 | 8/2013 | Golden et al. | |
| 8,540,590 | B2 | 9/2013 | Tsukada et al. | |
| 8,597,139 | B2 | 12/2013 | Jorgensen | |
| 8,715,109 | B2 | 5/2014 | Bennett et al. | |
| 8,758,161 | B2 | 6/2014 | Golden et al. | |
| 8,777,778 | B2 | 7/2014 | Solheim et al. | |
| 8,790,196 | B2 | 7/2014 | Solheim et al. | |
| 8,814,723 | B2 | 8/2014 | Tavares et al. | |
| 8,864,602 | B2 | 10/2014 | Curtis et al. | |
| 8,876,629 | B2 | 11/2014 | Deshmukh et al. | |
| 9,079,078 | B2 | 7/2015 | Greensmith et al. | |
| 9,079,089 | B2 | 7/2015 | Lokken et al. | |
| 9,079,368 | B2 | 7/2015 | Tavares et al. | |
| 9,101,811 | B1 | 8/2015 | Goudarzi et al. | |
| 10,065,084 | B2 * | 9/2018 | Myrhum | A63B 53/0466 |
| 10,232,230 | B2 * | 3/2019 | Takehara | A63B 53/0466 |
| 2004/0116207 | A1 | 6/2004 | De Shiell | |
| 2004/0192468 | A1 | 9/2004 | Onoda | |
| 2005/0096154 | A1 | 5/2005 | Chen | |
| 2005/0143189 | A1 | 6/2005 | Lai et al. | |
| 2005/0261082 | A1 | 11/2005 | Yamamoto | |
| 2006/0014592 | A1 | 1/2006 | Sugimoto | |
| 2008/0214322 | A1 | 9/2008 | Chou | |
| 2009/0088272 | A1 | 4/2009 | Foster et al. | |
| 2009/0092831 | A1 | 4/2009 | Stusgen et al. | |
| 2010/0048324 | A1 | 2/2010 | Wada | |
| 2011/0312437 | A1 | 12/2011 | Sargent | |
| 2012/0142451 | A1 | 6/2012 | De Shiell | |
| 2013/0252757 | A1 | 9/2013 | Deshmukh et al. | |
| 2014/0057737 | A1 | 2/2014 | Solheim | |
| 2014/0106897 | A1 | 4/2014 | Golden et al. | |
| 2014/0329616 | A1 | 11/2014 | Stokke | |
| 2015/0108681 | A1 | 4/2015 | Deshmukh et al. | |
| 2015/0290503 | A1 | 10/2015 | Su | |
| 2015/0298196 | A1 | 10/2015 | Su | |

FOREIGN PATENT DOCUMENTS

| | | |
|---|---|---|
| JP | 2003-250938 A | 9/2003 |
| JP | 2004-159794 | 6/2004 |
| JP | 2004-208728 | 7/2004 |
| JP | 2005-058461 | 3/2005 |
| JP | 2005-323686 | 11/2005 |
| JP | 2005-329154 | 12/2005 |
| JP | 2005-348895 | 12/2005 |
| JP | 2006-020860 | 1/2006 |
| JP | 2008-148762 A | 3/2008 |
| JP | 2009-011839 | 1/2009 |
| JP | 2014-501167 | 1/2014 |

OTHER PUBLICATIONS

U.S. Appl. No. 15/375,877, filed Dec. 12, 2016, Murphy et al.
U.S. Appl. No. 15/386,548, filed Dec. 21, 2016, Mark C. Myrhum.
The Royal and Ancient Golf Club of St. Andrews and USGA, Technical Description of the Pendulum Test revised version, Nov. 2003.
Machine Translation of JPH05-7261.

* cited by examiner

MULTI-MATERIAL GOLF CLUB HEAD

CROSS REFERENCE TO RELATED APPLICATIONS

This application is a continuation-in-part (CIP) of U.S. patent application Ser. No. 15/204,736, filed on Jul. 7, 2016, which is a CIP of U.S. patent application Ser. No. 15/047,975, filed on Feb. 19, 2016, which is a CIP of U.S. patent application Ser. No. 14/945,243, filed Nov. 18, 2015, the disclosure of which are all incorporated by reference in its entirety.

FIELD OF THE INVENTION

The present invention relates generally to an improved golf club head wherein a portion of the golf club head is made out of a multi-layered lightweight material. Using this lightweight material at different portions of the golf club head allows more discretionary mass to be created, which can be used to further improve the performance of the golf club by manipulating the center of gravity and moment of inertia of the golf club head.

BACKGROUND OF THE INVENTION

It is generally understood in the industry that the performance of a golf club head is largely dependent on the location of the Center of Gravity (CG) and Moment of Inertia (MOI) of the golf club head. In order to adjust the CG and MOI of a golf club head, golf club designers often strategically place mass at specific locations within the golf club head to achieve the desired CG and MOI. Pursuant to the design objective above, golf club designers have constantly struggled with ways to reduce unnecessary mass from various portions of the golf club in order to strategically place it at more desirable portions. This process is so important to the design of a golf clubs; the golf club design industry even has a specific term used to describe this type of mass savings, called "discretionary mass".

U.S. Pat. No. 6,152,833 to Werner et al. illustrates one of the earlier examples of trying to create more discretionary mass by creating a lightweight low density striking face that is supported to its rear by a hollow shell structure.

U.S. Pat. No. 6,860,824 to Evans illustrates another example of golf club designers attempt in creating more discretionary mass. In U.S. Pat. No. 6,860,824 it is contemplated that a golf club head has a body portion that is preferably composed of a lightweight non-metallic material to help reduce mass from the body portion of the golf club head.

U.S. Pat. No. 5,624,331 to Lo et al. illustrates another example of increasing discretionary mass by creating a composite-metal wood-style golf club head having a metal casing with at least two openings in the crown in which composite covers are disposed.

Finally, U.S. Pat. No. 7,361,100 to Morales et al. illustrates a modern day example of utilizing modern day materials to increase the discretionary mass within a golf club. More specifically, U.S. Pat. No. 7,361,100 discloses a golf club head that is formed with a crown having an aperture with an arcuate rear edge and a forward edge that is substantially parallel to the striking face, wherein the opening formed in the aperture by the ribs are filled with an organic-composite material such as carbon fiber epoxy.

It should be noted that although all of the above referenced prior art are very capable of reducing unnecessary mass from various portions of the golf club head, it fails to address the ancillary drawback associated with the usage of lightweight materials such as graphite composite. When lightweight materials are used to replace metallic materials at various portions of the golf club, the sound and feel of the golf club can significantly degrade, resulting in an undesirable golf club. Hence it can be seen from the above that although the current art is capable of creating discretionary mass by using lightweight materials, it fails to do so while minimizing the undesirable sound and feel of the golf club.

BRIEF SUMMARY OF THE INVENTION

One aspect of the present invention is a golf club head comprising of a striking face portion located at a frontal portion of said golf club head and a body portion attached to an aft portion of said striking face portion further comprising a crown portion and a sole portion. The golf club head has at least one of the crown portion and the sole portion further comprising of a base layer and a lightweight cover layer, wherein the base layer further comprises a plurality of cutouts and the lightweight cover layer has an Internal Exposure Percentage of greater than about 15% to about 60%.

In another aspect of the present invention, a golf club head comprising of a striking face portion located at a frontal portion of said golf club head and a body portion attached to an aft portion of said striking face portion further comprising a crown portion and a sole portion. The golf club head has at least one of the crown portion and the sole portion further comprising of a base layer and a lightweight cover layer, wherein the base layer further comprises a plurality of cutouts and the lightweight cover layer has an Internal Exposure Percentage of greater than about 15% to about 60%, and the base layer has a maximum thickness of less than about 0.50 mm and the lightweight cover layer has a maximum thickness of less than about 0.30 mm.

In another aspect of the present invention the club head has a Center of Gravity location having a CG-C location greater than about 30 mm.

In another aspect of the present invention, the golf club further comprises of a blend at the interface between the base layer and the lightweight cover layer, creating a smooth thickness transition between the base layer and the lightweight cover layer.

In another aspect of the present invention, the golf club head further comprises of a stiffening member around a perimeter of at least one of a plurality of cutouts.

In another aspect of the present invention, the golf club head further comprises an adhesive layer sandwiched between said base layer and said lightweight cover layer, wherein the adhesive layer is a film type adhesive having a thickness of less than about 15 mils.

In another aspect of the present invention is a golf club head comprising of a frontal portion including a striking face portion, defined as any portion of said golf club head located forward of a bifurcation line, the bifurcation line is defined as a plane placed at a distance of 10 mm behind a hosel bore axis. The golf club head also comprises of a rear portion further comprising a lightweight rear toe portion, a lightweight rear heel portion, and a rear central portion; defined by a plurality of trifurcation lines placed at a distance of 15 mm on both sides of a geometric center of a striking face. A mass of the rear central portion is greater than a mass of said lightweight rear heel portion, and the mass of the rear central portion is greater than a mass of the lightweight rear toe portion.

In another aspect of the present invention the lightweight base layer wraps around a toe skirt portion of the golf club head, at least partially encompassing a majority of the crown and only a toe portion of the sole.

In another aspect of the present invention the lightweight base layer wraps around a toe skirt portion of the golf club head and further comprises of at least one notch around a skirt portion of the lightweight cover layer.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
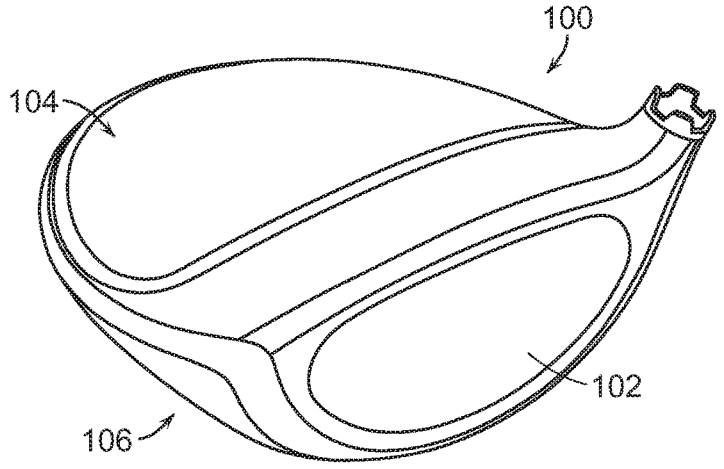
FIG. 1 of the accompanying drawings shows a perspective view of a golf club head in accordance with a preferred exemplary embodiment of the present invention.

FIG. 1 shows a perspective view of a golf club head 100 in accordance with an exemplary embodiment of the present invention. Golf club head 100 shown in FIG. 1 may generally have a striking face 102 attached to a frontal portion of the golf club head 100 and a body portion attached to an aft portion of the striking face 102. The body portion may generally be further comprised of a crown portion 104 near a top of the golf club head 100 and a sole portion 106 located near a bottom of the golf club head 100. Finally, and most importantly, the crown portion 104 of the golf club head 100 in accordance with the exemplary embodiment of the present invention may be further comprised out of multiple layers that have different materials. Alternatively speaking, it can be said that the golf club head 100 in accordance with an exemplary embodiment of the present invention may have a multi-material crown.

Figure 2:
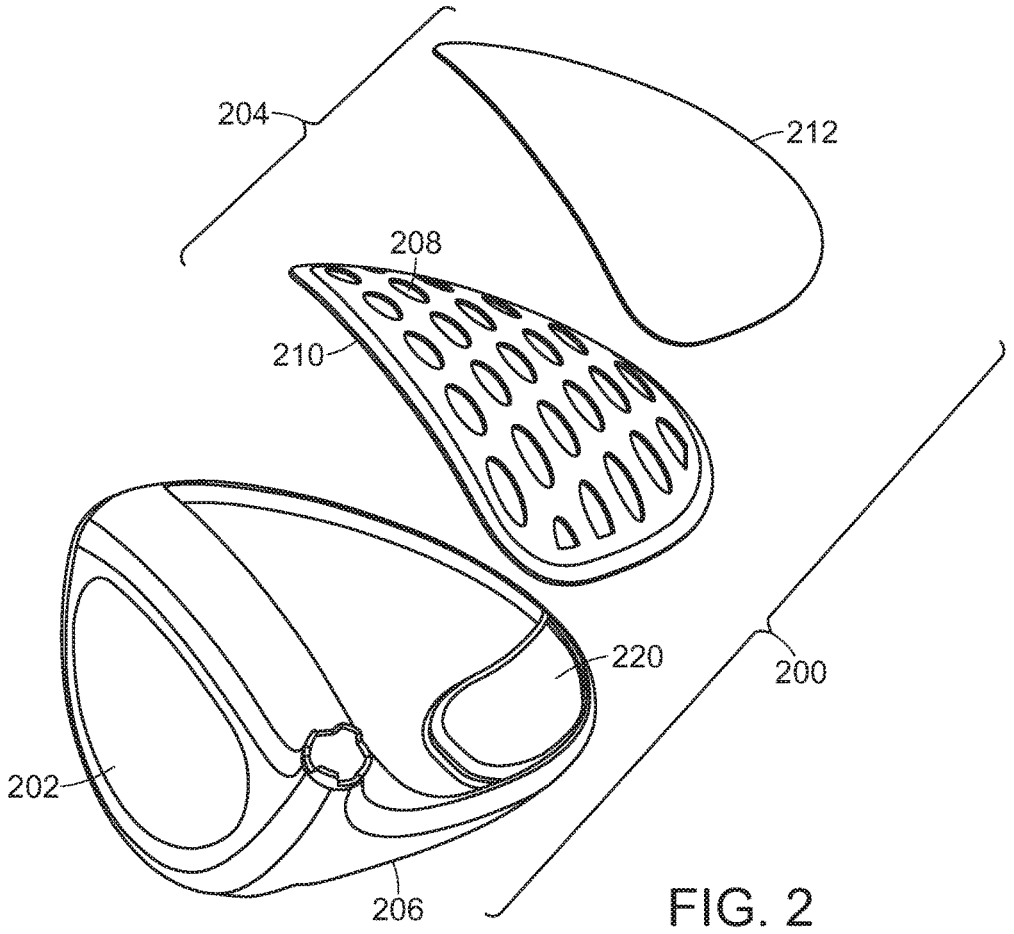
FIG. 2 of the accompanying drawings shows an exploded perspective view of a golf club head in accordance with the embodiment of the present invention shown in FIG. 1.

In order to provide a more clear illustration of the various components of the golf club head 100 in accordance with this exemplary embodiment of the present invention FIG. 2 is provided herein. FIG. 2 shows an exploded perspective view of a golf club head 200 illustrating that the multi-material crown portion 204 may be further comprised out of a base layer 210 and a lightweight cover layer 212.

The base layer 210 may generally be comprised out of a titanium type material with a density of between 4.0 g/cm$^3$ and about 4.7 g/cm$^3$, more preferably between about 4.1 g/cm$^3$ and about 4.6 g/cm$^3$, and most preferably about 4.4 g/cm$^3$. This titanium base layer 210 not only serves to help provide structural rigidity to the crown portion 204 of the golf club head 200, but can also help contribute to the generation of discretionary mass by incorporating a plurality of cutouts 208 across the entire area. The plurality of cutouts 208 shown in this exemplary embodiment of the present invention may generally be oval or circular shaped in order to provide the most mass savings all while preserving the structural integrity of the base layer 210. However, it should be noted that although the oval or circular shaped cutouts 208 are preferred, many other types of cutout 208 geometry can be used to remove material from the base layer 210 without departing from the scope and content of the present invention.

When holes are cut out from a material, it is generally understood that the structural rigidity of the material may suffer. Hence, in order to address the potential degradation of the structural rigidity in the crown portion 204 due to the plurality of cutouts 208, the present invention may utilize a combination of different technologies. First and foremost, the present invention attempts to recapture some of the lost structural rigidity by utilizing a higher strength titanium material for the base layer 210. In one preferred embodiment of the present invention ATI 425 Titanium material is used; however, numerous other high strength material such as SP 700 Titanium, KS 120 Titanium, KS 100 Titanium, Titanium 8-1-1- may all be used without departing from the scope and content of the present invention so long as it provides an elevated strength performance. In addition to the utilization of a high strength titanium material for the base layer 210, the present invention also utilizes a lightweight cover layer 212.

The lightweight cover layer 212 shown in FIG. 2 may generally be a lightweight material with a density that is lower than the density of the base layer 210, sole 206, and the striking face 202. In one exemplary embodiment the layer of lightweight material 210 may be constructed using an aluminum material with a density of about 2.7 g/cm$^3$, a magnesium material with a density of about 1.738 g/cm$^3$, a composite type material with a density of about 1.50 g/cm$^3$, or any other material having a lower density than the density of the first material all without departing from the present invention. In a preferred embodiment of the present invention the material used to create lightweight cover layer 212 may generally be a composite material having a very low fiber areal mass. More information regarding composite materials with a low fiber areal mass in a golf club head may be found in U.S. patent application Ser. No. 14/834,654 by Deshmukh, the disclosure of which is incorporated by reference in its entirety.

The combination of the base layer 210 and the lightweight cover layer 212 allows the golf club head 200 to achieve the maximum amount of discretionary mass all while preserving the structural rigidity in the crown 204 portion to be able to endure the high impact stressed between a golf club 200 and a golf ball. The amount of discretionary mass saved from the crown 204 portion can then easily be applied to more strategic locations within a golf club head 200.

One exemplary location of this more strategic location of discretionary mass can also be seen in FIG. 2 in the form of a mass member 220. In the current exemplary embodiment of the present invention, the discretionary mass may be concentrated towards the rear sole portion of the golf club head 200, however the mass member 220 could be located at alternative locations within the golf club head 200 without departing from the scope and content of the present invention. In the current exemplary embodiment of the present invention the amount of additional mass located in the mass member may generally be greater than about 5 grams, more preferably greater than about 7 grams, and most preferably greater than about 9 grams without departing from the scope and content of the present invention.

Figure 3:
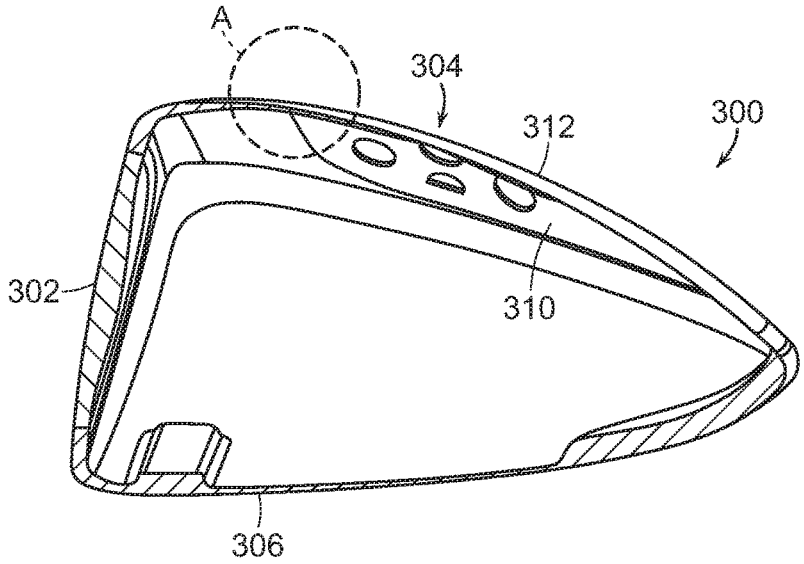
FIG. 3 of the accompanying drawings shows a cross-sectional view of the golf club head shown in FIG. 1, taken down the middle of the golf club head in a forward and aft orientation.

In order to illustrate how the various components interact with each other in an assembled setting, FIG. 3 of the accompanying drawing is provided illustrating a cross-sectional view of a golf club head 300. This cross-sectional area is taken along the center of the golf club head in a forward aft orientation, passing through the center of the striking face. In this cross-sectional view we can see that the golf club head 300 still has a striking face 302, a crown portion 304, and a sole portion 306. The crown portion 304, as previously illustrated in the exploded view shown in FIG. 2, may be further comprised out of a base layer 310 and a lightweight cover layer 312. First and foremost, it can be seen that the thickness of the crown portion 304 is extremely small, allowing the golf club head 300 to achieve the discretionary mass that is desired. Given how thin the entire thickness of the crown portion 304 is, it can be easily deduced that the lightweight cover 312 could be even thinner. In order to illustrate the thickness of the crown portion 304 together with the base layer 310 as well as the lightweight cover layer 312, FIG. 4 is provided, which focuses on an enlarged cross-sectional view of circular region A, shown in FIG. 3.

Figure 4:
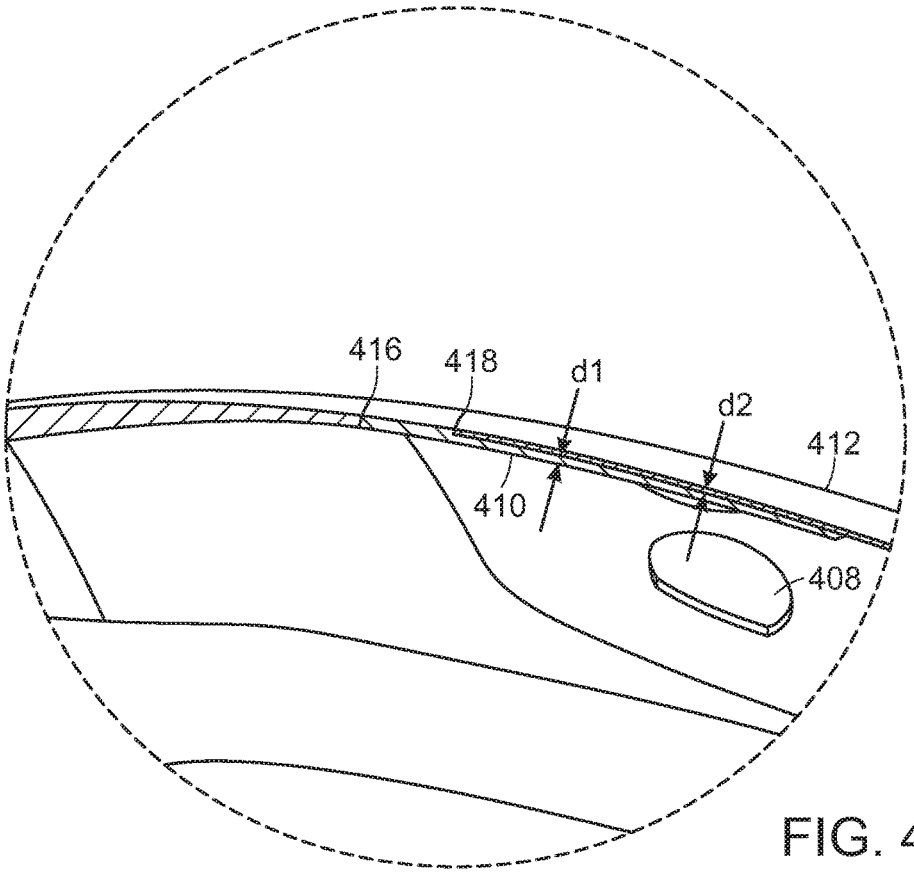
FIG. 4 of the accompanying drawings shows an enlarged cross-sectional view of a portion of a golf club head identified by circular region A shown in FIG. 3.

FIG. 4 of the accompanying drawings shows an enlarged cross-sectional view of a portion of a crown 304 of a golf club head 300 as illustrated by circular region A shown in FIG. 3. First and foremost, it should be noted that the base layer 410 shown in FIG. 4 may generally be attached to the frontal crown portion of the golf club head via a welding process, near welding joint 416. Since the base layer 410 and the frontal portion of the crown are both made out of a titanium type material, they may generally be welded together without any issues. Right behind the welding joint 416, it can be seen that the base layer 410 may have a step 418 to allow the lightweight cover layer 412 to be placed above the base layer 410. In one exemplary embodiment of the present invention, the lightweight cover layer 412 may be attached to the base layer 410 by using an adhesive type material. In one preferred embodiment of the present invention, the adhesive may be a film type adhesive having a thickness of less than about 2.5 mils and has a weight of 0.015 lb/ft$^2$. Utilizing an adhesive film may be preferred over a liquid type glue in the present invention as the geometry of the base layer 410 having the plurality of cutouts may prevent good even distribution of a liquid type glue. The adhesive film may generally have a Modulus Elasticity of about 161,000 psi, a Shear Modulus of about 60,000 psi, with a Poisson's Ratio of about 0.34. However, it should be noted that if a composite material is used, the lightweight cover layer 412 can be directly molded over the base layer 410 without departing from the scope and content of the present invention. In the current exemplary embodiment of the present invention, the base layer 410 may generally have a thickness dl that is less than about 0.50 mm, more preferably less than about 0.40 mm, and most preferably less than about 0.35 mm, all without departing from the scope and content of the present invention. The lightweight cover layer 412 shown in this current exemplary embodiment of the present invention, due to the fact that is may be made out of a lightweight composite type material, may generally have a thickness d2 that is less than about 0.30 mm, more preferably less than about 0.25 mm, and most preferably less than about 0.20 mm.

It is worth noting here that although the above discussion focuses on the mass, thickness, and density of the different layers in order to reduce unnecessary mass and create discretionary mass, the crux of the current invention is based on the ability to achieve the mass savings without sacrificing the all-important sound and feel of the golf club head. Based on the discussion above one can clearly see that the material used for the lightweight cover layer, by the nature of having a lower density, can help reduce the mass of the golf club when it is used compared to standard titanium type material. However, the present invention recognizes that when lightweight material is used to replace traditional titanium materials, the sound and feel of the golf club head suffers. This degradation in the sound and feel of the golf club when lightweight material is used occurs because the acoustic vibration that occurs during impact with a golf ball will differ depending on the material.

The present invention not only recognizes the potential for degradation of sound, but also addresses this issue by finding the proper balance between the amount of mass saving achieved together with the preservation of the sound and feel of the golf club head. In order to achieve this harmonious balance, the present invention has found that by focusing on the amount of the lightweight cover layer 412 being exposed internally through the cutouts 408 of the base layer 410 will help preserve the acoustic signature and feel of the golf club head all while obtaining the discretionary mass desired. This amount of exposed lightweight cover layer 412 through the cutouts 408 is generally expressed as a percentage of the total internal surface area of the lightweight cover layer 412, and is extremely critical to the proper functionality of the present invention. More specifically, it can be said that in a preferred embodiment of the present invention, only between about 15% to about 60% of the internal surface area of the lightweight cover layer 412 is exposed internally through the cutouts 408, more preferably between about 20% to about 50%, and most preferably between about 25% to about 45%. The range of internal surface area exposed is critical to the proper functionality of the present invention because if too much of the lightweight cover layer 412 is exposed internally through the cutouts 408, the acoustic sound and feel of the golf club suffers. Alternatively, if too little of the internal surface area of the lightweight cover layer 412 is exposed through the cutouts 408, then the mass savings does not become significant enough to achieve any mass savings.

In order to quantify this very important percentage, the present invention has created a very simplistic term called the "Internal Exposure Percentage", defined as the internal surface area of the lightweight cover layer 412 that is exposed through the cutouts 408 divided by the total internal surface area of the lightweight cover layer 412. This "Internal Exposure Percentage" is summarized by Equation (1) below:

$$\text{Internal Exposure Percentage} = \frac{\text{Internal Surface Area Exposed through Cutouts}}{\text{Total Internal Surface Area}} \quad \text{Eq. (1)}$$

As described above, the Internal Exposure Percentage of a lightweight cover layer 412 for a golf club head in accordance with the present invention is most preferably between about 15% to about 60%, more preferably between about 20% to about 50%, and most preferably between about 25% to about 45%.

Figure 5:
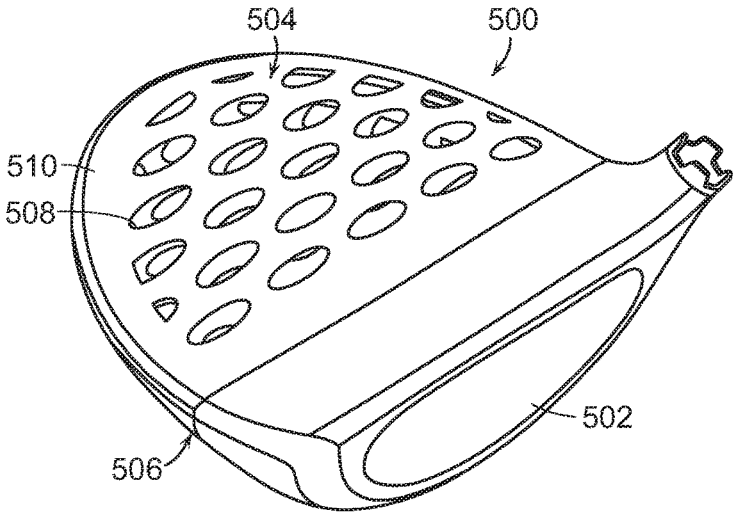
FIG. 5 of the accompanying drawings shows a perspective view of a golf club head in accordance with an alternative embodiment of the present invention.

FIG. 5 of the accompanying drawings shows a perspective view of a golf club head 500 in accordance with an alternative embodiment of the present invention. In this embodiment of the present invention, the base layer 510 may not be limited to the crown portion 504 of the golf club head 500, but could be applied towards the sole portion 506 of the golf club head 500 without departing from the scope and content of the present invention. In order to provide a more clear illustration of the various components of the golf club head 500, FIG. 6 providing an exploded view is also provided.

Figure 6:
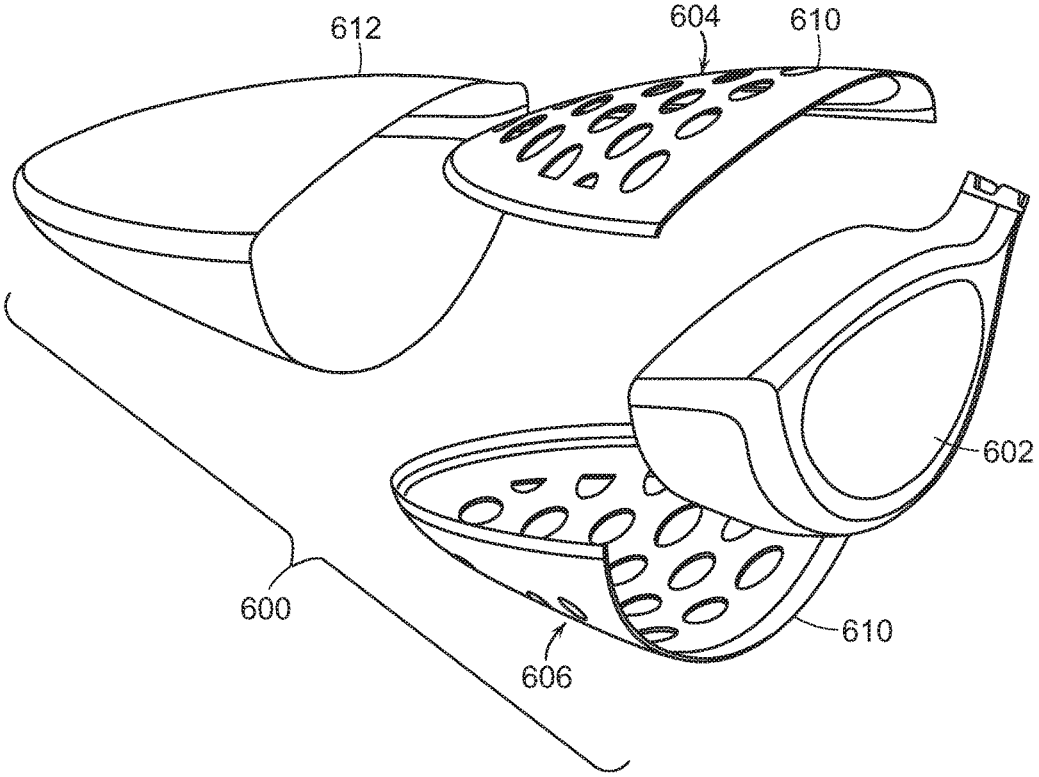
FIG. 6 of the accompanying drawings shows an exploded perspective view of a golf club head in accordance with the alternative embodiment of the present invention shown in FIG. 5.

FIG. 6 of the accompanying drawings shows an exploded perspective views of a golf club head 600 in accordance with the alternative embodiment of the present invention shown in FIG. 5. In this exploded view of the present invention, it can be seen that the sole 606 portion of the golf club head 600 may also contain a base layer 610 in addition its utilization in the crown 604 portion. In addition to the above, FIG. 6 also illustrates the shape and dimension of the lightweight cover layer 612, which was previously removed from FIG. 5 to illustrate the cutouts 508. The cover layer 612 does not need to be substantially planar as shown originally in FIG. 2, but rather could take on the external shape of a golf club head like a skin without departing from the scope and content of the present invention. It should be noted here that although the base layer 610 covers more of the golf club head, the percentage of internally exposed lightweight cover layer 612 is maintained to preserve the perfect balance between mass savings and preservation of sound and feel.

Figure 7:
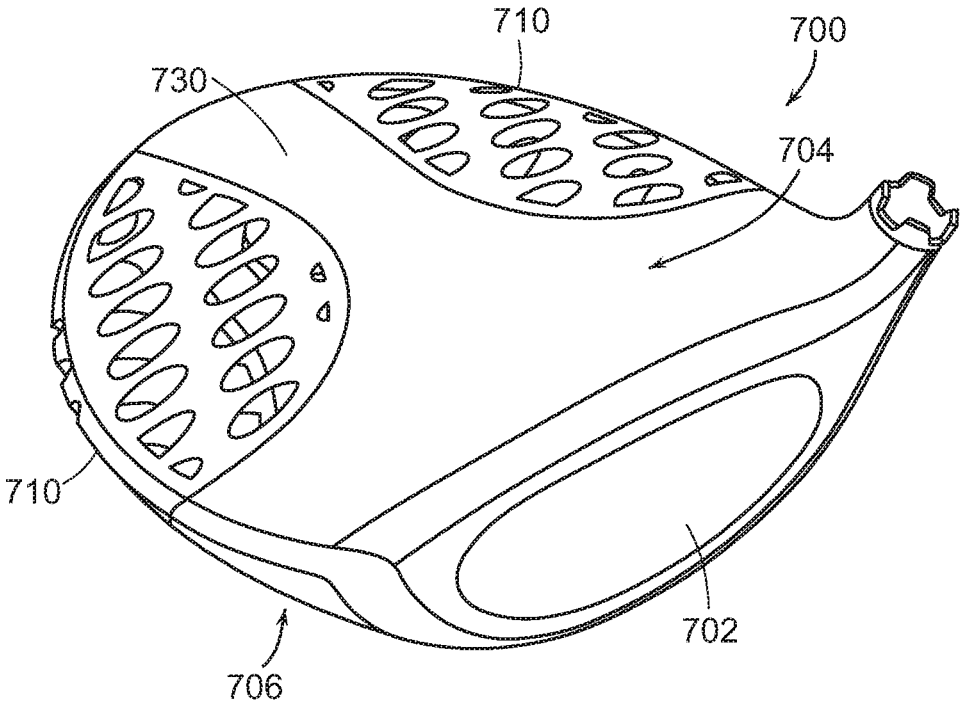
FIG. 7 of the accompanying drawings shows a perspective view of a golf club head in accordance with a further alternative embodiment of the present invention.

FIG. 7 of the accompanying drawings shows another perspective view of a golf club head 700 in accordance with a further alternative embodiment of the present invention. More specifically, in this alternative embodiment of the present invention the base layer 710 may be used at the toe and heel portion of the body of the golf club head 700 allowing the central portion of the golf club head 700 to create a bridge member 730 without departing from the scope and content of the present invention. Alternatively speaking, it can be said that the bridge member 730 separates the body portion into a heel body portion and a toe body portion. The bridge member 730, as shown in this exemplary embodiment of the present invention, may generally help create more structural rigidity within the golf club head 700, allowing the base layer 710 to be even thinner in some instances.

Figure 8:
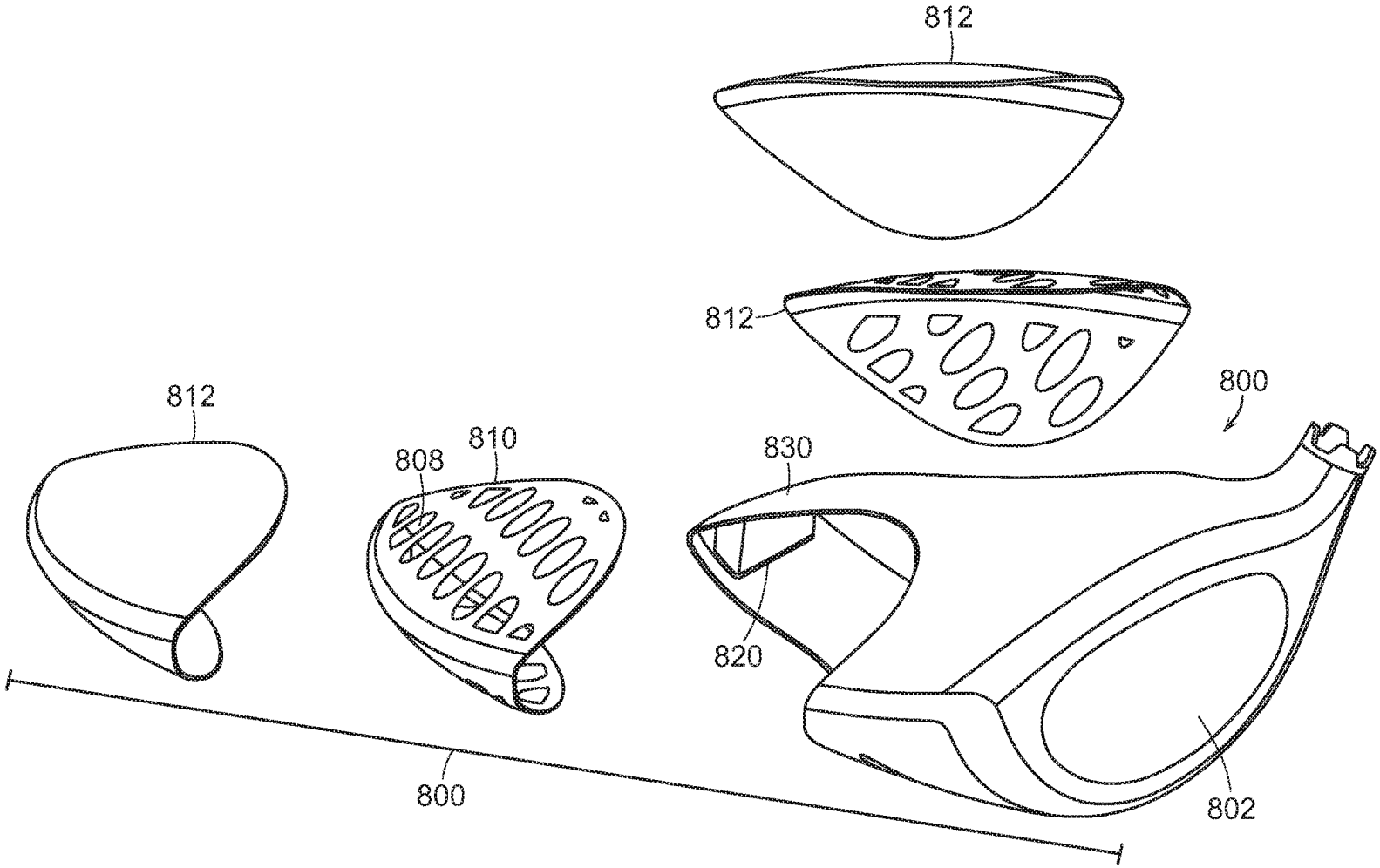
FIG. 8 of the accompanying drawings shows an exploded perspective view of a golf club head in accordance with the further alternative embodiment of the present invention shown in FIG. 7.

FIG. 8 of the accompanying drawings shows an exploded perspective view of the golf club head 800 shown in FIG. 7. This exploded perspective view not only allows the lightweight cover layer 812 to be shown more clearly, but also illustrates the mass member 820 located at the rear portion of the golf club head 800. It can be seen in this exploded perspective view that the mass member 820 is located along the bridge member 830 to allow the mass member 820 to be secured to the golf club head 800 without any need for additional features. Finally, it is worth noting that even in this alternative embodiment of the present invention, the golf club head will have the same percentage of internally exposed lightweight cover layer 812 through the cutouts 808 as previously discussed in order to preserve the perfect balance between mass savings and the preservation of sound and feel.

Figure 9:
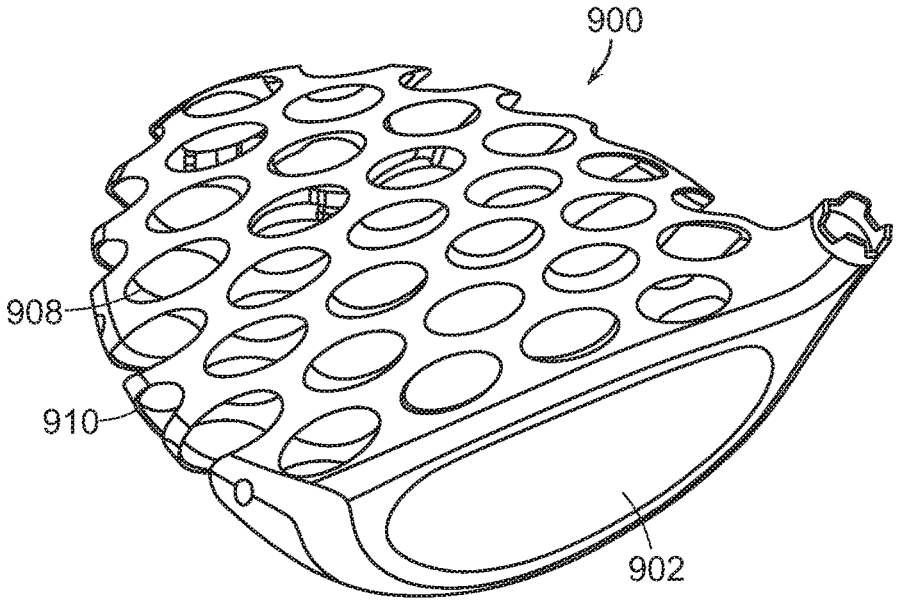
FIG. 9 of the accompanying drawings shows a perspective view of a golf club head in accordance with an even further alternative embodiment of the present invention.

FIG. 9 of the accompanying drawings shows a perspective view of a golf club head 900 in accordance with a further alternative embodiment of the present invention. In this alternative embodiment of the present invention the golf club head 900 could incorporate the plurality of cutouts 908 through the entire body portion to create the base layer 910. This golf club head 900 may generally be covered with a lightweight cover layer as previously discussed in prior embodiments, but the cover layer is not shown in FIG. 9 to allow more clarity of the internal structure.

Figure 10:
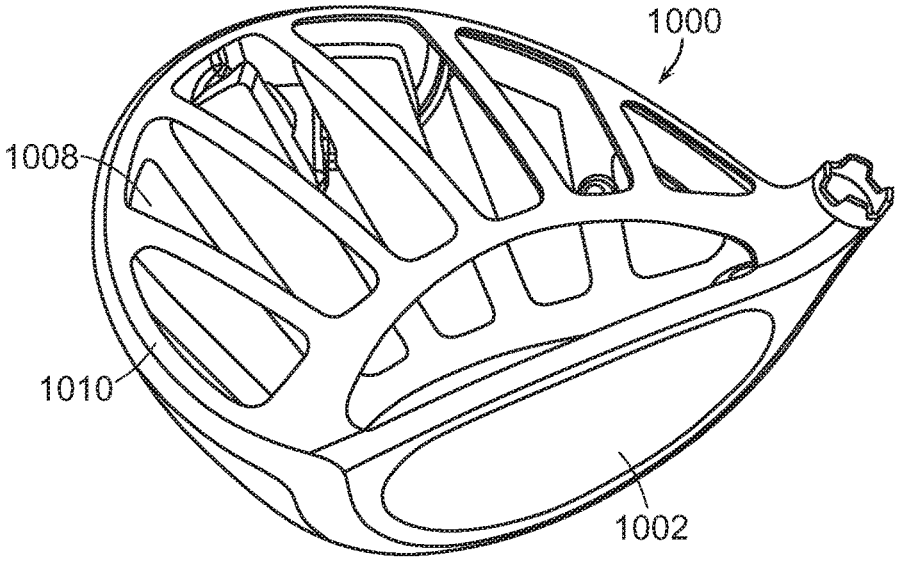
FIG. 10 of the accompanying drawings shows a perspective view of a golf club head in accordance with another further alternative embodiment of the present invention.

FIG. 10 of the accompanying drawings shows a perspective view of a golf club head 1000 in accordance with a further alternative embodiment of the present invention. FIG. 10 shows a slightly different internal structure wherein the base layer 1010 may be created using cutouts 1008 that is not circular in shape. In fact, in alternative embodiments of the present invention the cutouts 1008 may take on any shape that is circular, oval, rectangular, or any other shape all without departing from the scope and content of the present invention so long as it has an internal exposure percentage in accordance with the discussion above.

Figure 11:
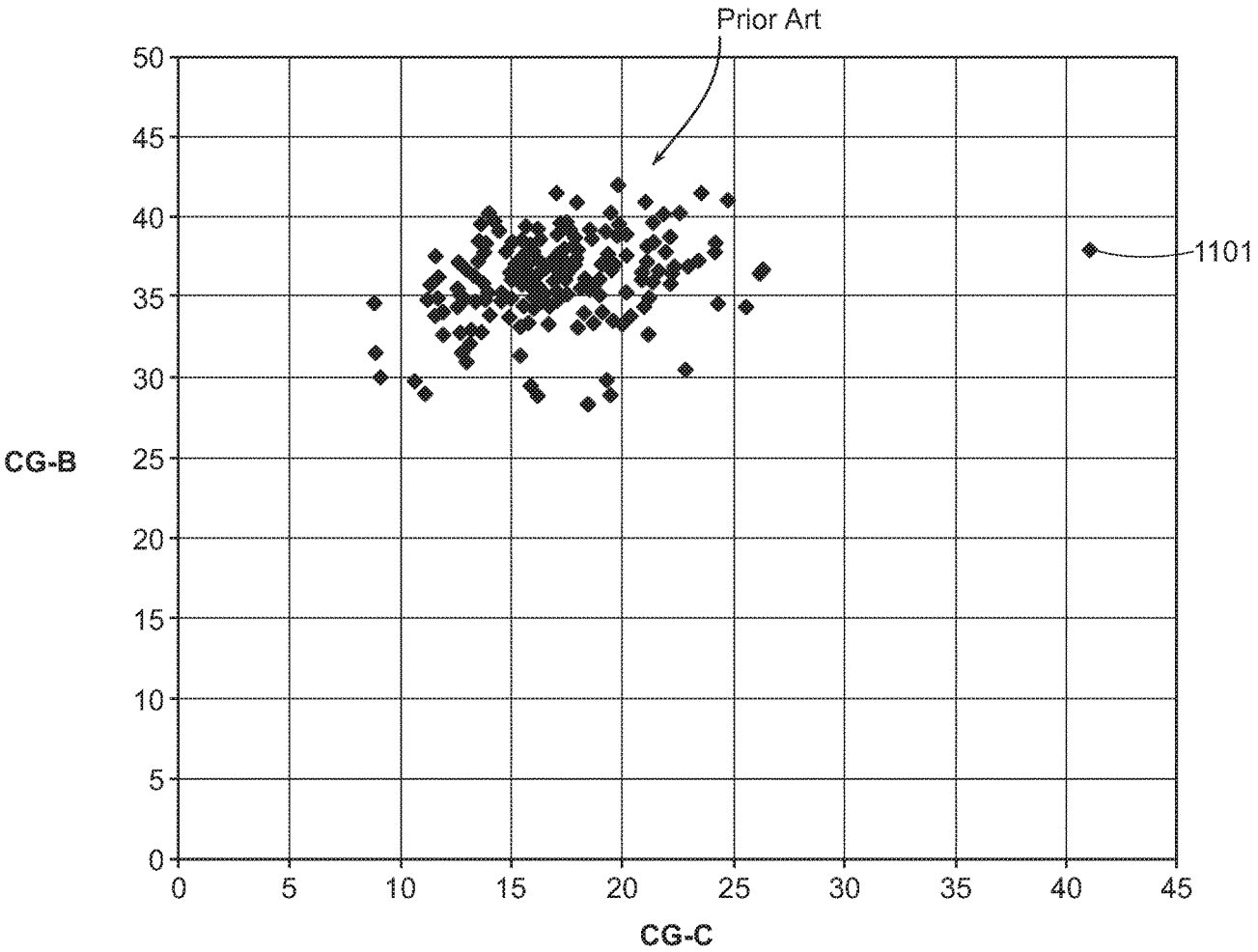
FIG. 11 of the accompanying drawings shows a graphical representation of a Center of Gravity location of the current golf club head compared to prior art golf club heads.

FIG. 11 of the accompanying drawings shows a chart indicating the potential CG location that could be achieved in a golf club head that incorporates the multi-material technology associated with the present invention. In FIG. 11, the x-axis is representative of the location of the CG away from the shaft axis in a forward to aft orientation called CG-C, while the y-axis is representative of the location of the CG location away from the shaft axis in a heel to toe orientation called CG-B. More details regarding the definition of the x and y axes, shown in FIG. 11 as CG-C and CG-B respectively, will be illustrated in subsequent FIG. 12. It should be noted that in FIG. 11, the prior art CG locations are all concentrated near a cluster with a CG-B between about 35 mm to about 45 mm, and a CG-C location between about 7 mm to about 27 mm. The current invention has a CG location at point 1101, which indicates that it is capable of achieving a CG-B location of about 37 mm and a CG-C location of greater than about 40 mm.

Figure 12A:
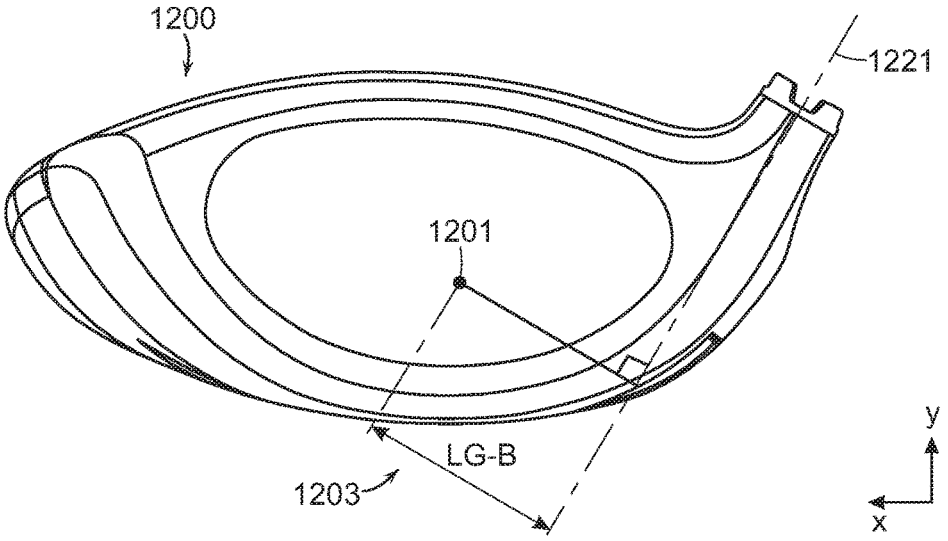
FIG. 12A of the accompanying drawings shows a frontal view of a golf club head illustrating one of the measurements used for defining CG location of a golf club head.
Figure 12B:
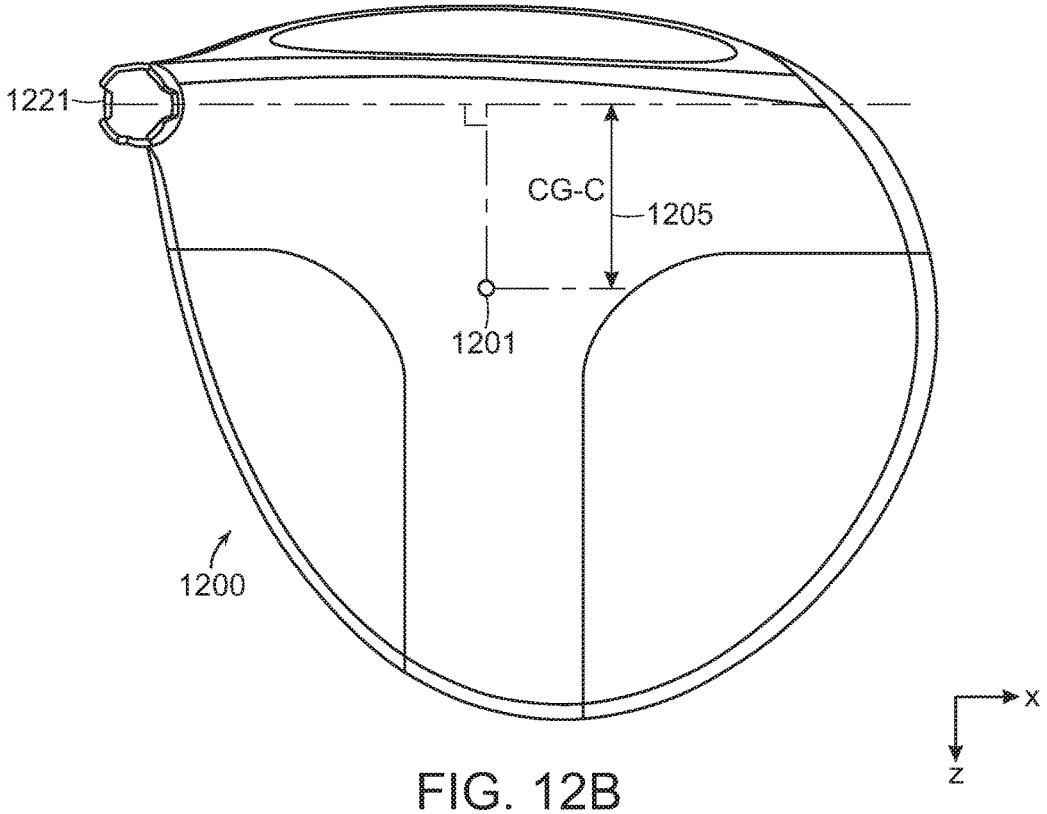
FIG. 12B of the accompanying drawings shows a top view of a golf club head illustrating another measurement used for defining CG location of a golf club head.

In order to further explain the definition of CG-B and CG-C, FIGS. 12A and 12B have been provided here. FIG. 12A shows a frontal view of a golf club head 1200 and the measurement of the CG-B is shown here as being the distance 1203 between the hosel bore axis 1221 and the CG location 1201. It should be noted that CG-B is defined as the location of the CG location 1201 being perpendicular to the hosel bore axis in the x-y plane, as a function of the lie angle of the golf club head 1200. Needless to say, different golf club heads with different lie angles will yield different CG-B results, but the ability to place the CG location 1201 away from the hosel bore axis 1221 is depicted here in FIG. 12A. FIG. 12B shows a top view of a golf club head 1200 allowing the measurement of CG-C distance 1205 to be shown more clearly. CG-C, as shown in FIG. 12B, is defined as the location of the CG 1201 measured in a perpendicular direction along the x-z plane moving rearward of the club head 1200.

When viewing FIG. 11 in combination with FIG. 12A and 12B, it can be seen here that the present invention, by utilizing the multi-material technology, is capable of achieving an extremely aggressive CG location in the forward to aft orientation, depicted as CG-C. Moreover, the present invention is capable of achieving this extreme CG-C compared to the prior art, without sacrificing the CG-B values. Alternatively speaking, it can be said that a golf club in accordance with the present invention may be capable of achieving a CG-C measurement of greater than about 30 mm, more preferably greater than about 35 mm, and most preferably greater than about 40 mm all without departing from the scope and content of the present invention.

Figure 13:
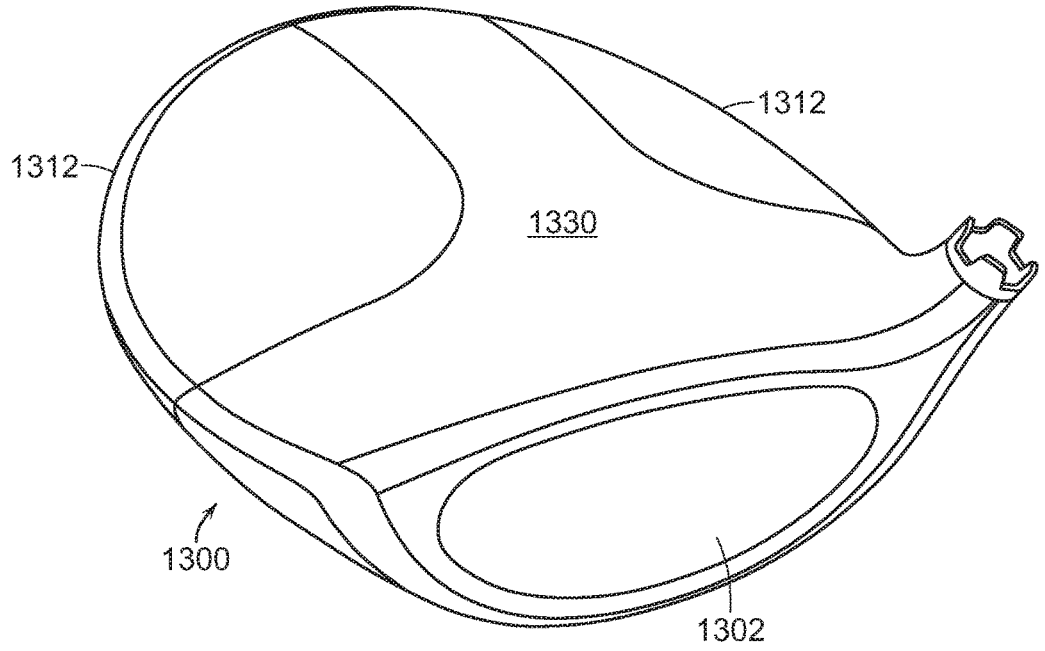
FIG. 13 of the accompanying drawings shows a perspective view of a golf club head in accordance with an alternative embodiment of the present invention.

FIG. 13 of the accompanying drawings shows a perspective view of a golf club head 1300 in accordance with a further alternative embodiment of the present invention. At first glance, the embodiment of the golf club head 1300 shown in FIG. 13 may look similar to golf club head 700 shown in FIG. 7 in that golf club head 1300 also has a striking face 1302 and a bridge member 1330. However, the present embodiment differs from golf club head 700 in that golf club head 1300 completely removes the need of a base layer, and only incorporates a lightweight cover layer 1312 at the toe and heel side of the bridge member 1330. In this alternative embodiment of the present invention, the lightweight cover layer 1312 may be a lightweight high strength titanium material having a density of between about 4.0 $g/cm^3$ and about 4.7 $g/cm^3$, more preferably between 4.1 $g/cm^3$ and about 4.6 $g/cm^3$, and most preferably about 4.5 $g/cm^3$.

Figure 14:
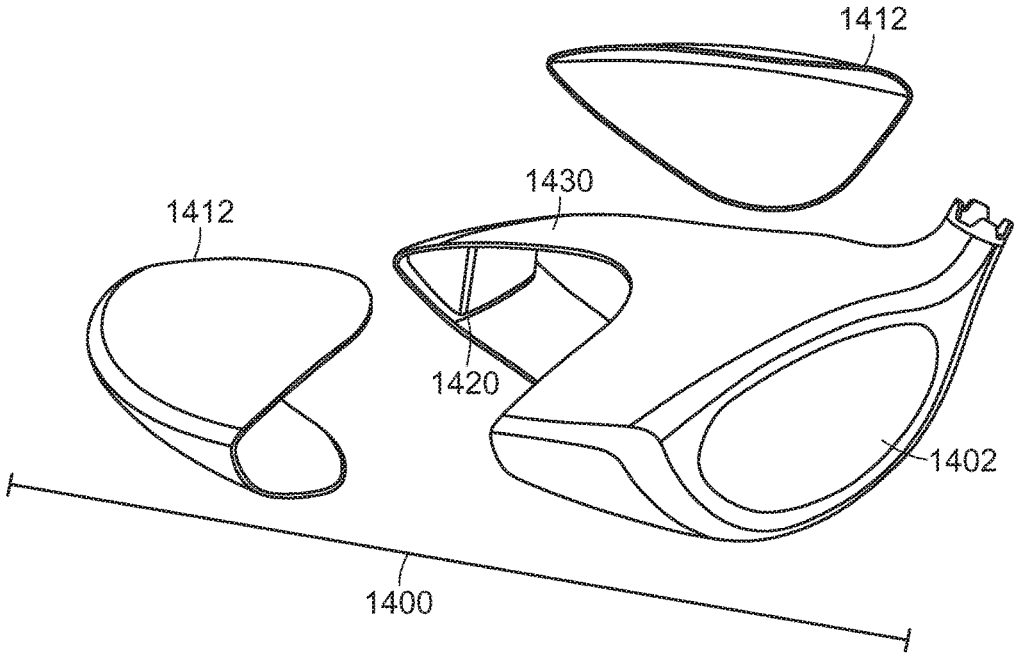
FIG. 14 of the accompanying drawings shows an exploded perspective view of a golf club head in accordance with an alternative embodiment of the present invention.

FIG. 14 of the accompanying drawings is provided here to provide a clearer illustration of the construction of a golf club head in accordance with this alternative embodiment by separating the various components of golf club head 1400. The exploded perspective view of golf club head 1400 shown in FIG. 14 illustrates that in this current embodiment of the present invention, the lightweight cover 1412 creates the rear heel and rear toe portion of the golf club head 1400 without the need for a base layer. This embodiment of the present invention may generally utilize a higher strength material for the lightweight cover 1412, as it needs to create more structural rigidity than prior embodiments where the base layer exists.

Figure 15:
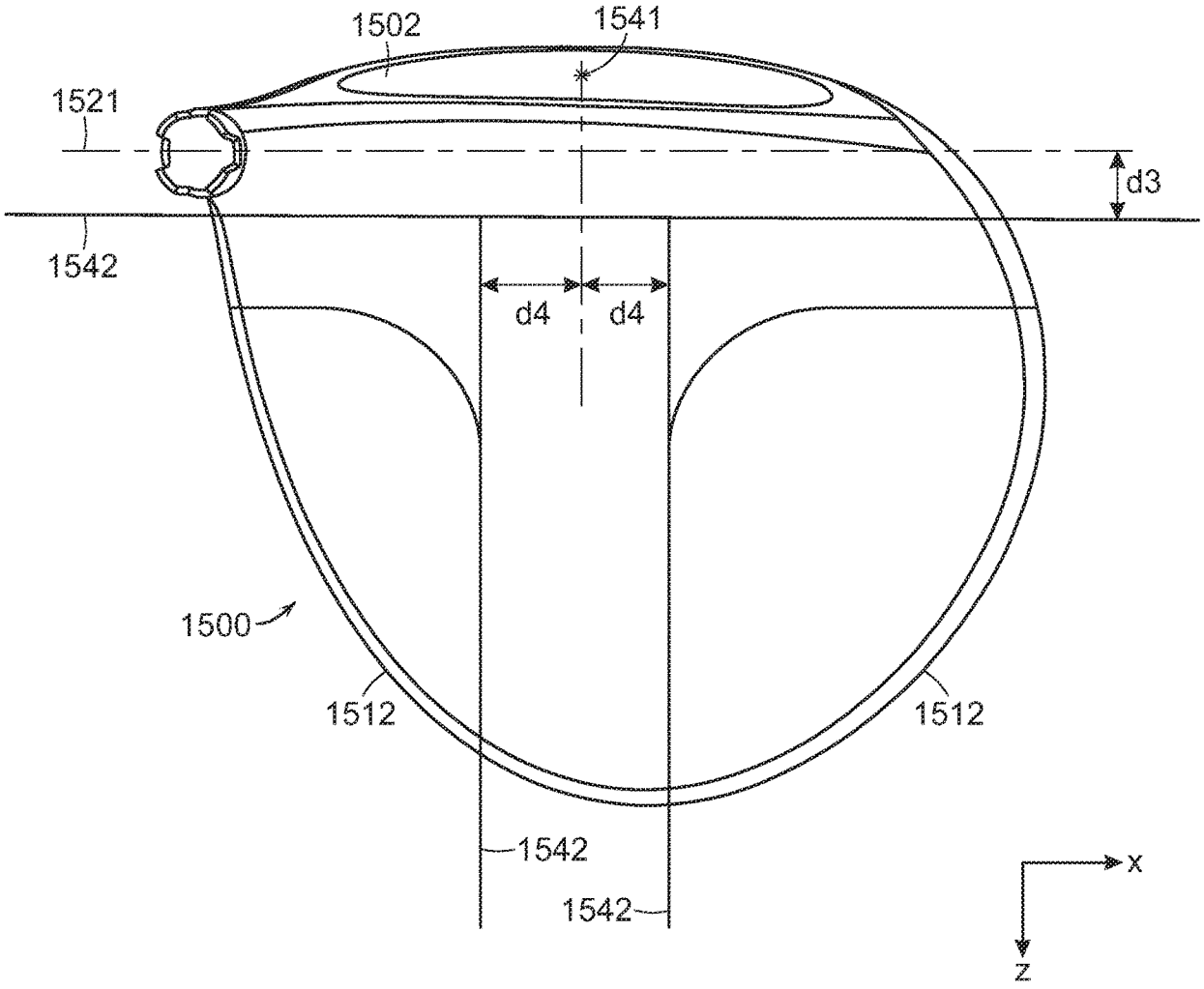
FIG. 15 of the accompanying drawings shows a top view of a golf club head in accordance with an alternative embodiment of the present invention.

In order to further illustrate the weight distribution of the current exemplary embodiment of the present invention, FIG. 15 is provided herein showing a top view of a golf club head 1500 that divides the golf club head 1500 into four separate components. The present invention utilizing the multi-material technology can help minimize the weight of the heel and toe body portions of the golf club head to increase the weight of the golf club head 1500 in the central portion to help achieve the CG locations discussed above. In this exemplary embodiment of the invention, the first bifurcation line 1542 separates the frontal portion of the golf club head 1500 from the rear body portion of the golf club head 1500. The bifurcation line 1542 is measured from the hosel bore axis 1521, and is set rearward along the z-axis at a distance d3 of 10 mm. Once the bifurcation line 1542 is created, two trifurcation lines 1542 are drawn to separate the rear body portion into three separate components. The two trifurcation lines 1542 are defined using the geometric center 1541 of the striking face 1502 and offset a distance d4 of 15 mm in both the heel and toe direction along the x-axis. Once these sections are defined, FIG. 16 can be used to further explain the weighting aspects of the current inventive golf club head 1500.

Figure 16:
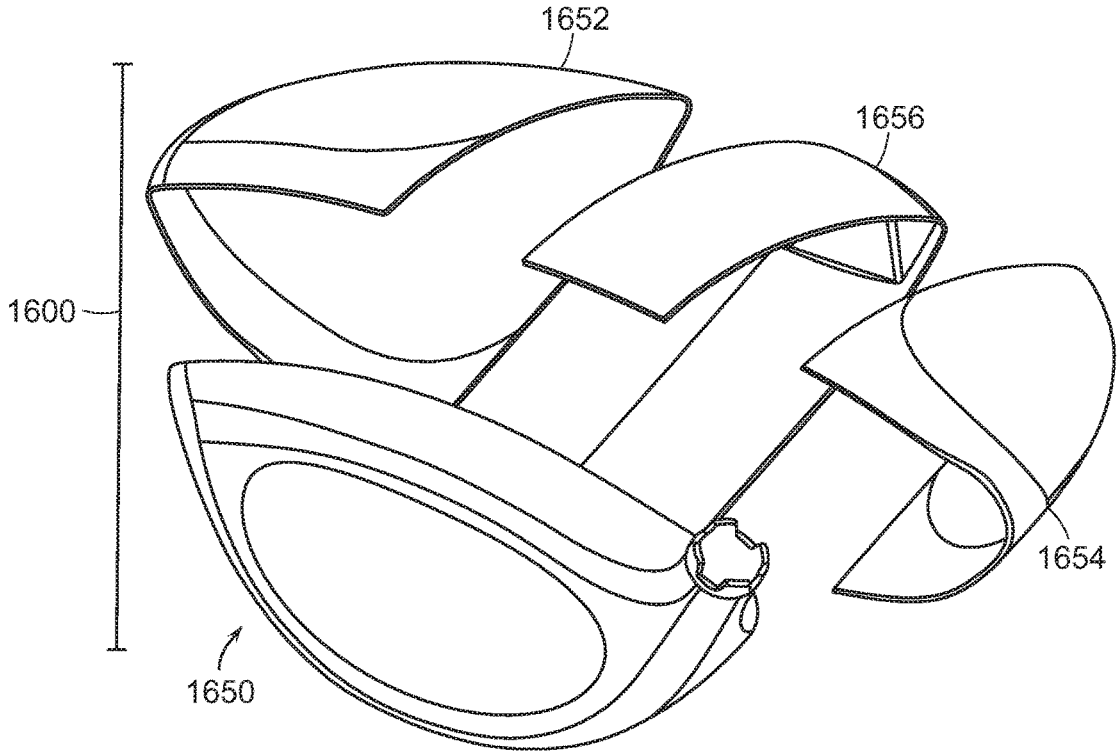
FIG. 16 of the accompanying drawings shows an exploded perspective view of a golf club head separated into four different pieces according to a methodology described in the present invention.

FIG. 16 of the accompanying drawings shows an exploded perspective view of a golf club head 1600 that is divided using the very specific dimensions articulated above. The golf club head 1600 here is separated into four different parts, identified as frontal portion 1650, rear toe portion 1652, rear heel portion 1654, and rear central portion 1656. A golf club in accordance with an exemplary embodiment of the present invention may generally have a lightweight rear toe portion 1652 and a lightweight rear heel portion 1654, while having a significantly heavier rear central portion 1656. Alternatively speaking, it can be said that the mass of either of the rear toe portion 1652 or the rear heel portion 1654 is lighter than the mass of the rear central portion 1656. In fact, the mass of the rear toe portion 1652 and the rear heel portion 1654 are so light relative to the rear central portion 1656, it can be said that the combined mass of the rear toe portion 1652 and the rear heel portion 1654 is still less than the mass of the rear central portion 1656. In order to understand the dramatic difference in mass between the different regions, it can be said the ratio of the mass of the rear toe portion 1652 combined with the mass of the rear heel portion 1654 all divided by the mass of the rear central portion 1656 is less than 1.00, more preferably less than about 0.80, and most preferably less than about 0.65.

In one exemplary embodiment of the present invention, the mass of the rear toe portion 1652 may generally be less than about 30 grams, more preferably less than about 25 grams, and most preferably less than about 22 grams. In this exemplary embodiment of the present invention, the mass of the rear heel portion 1654 may generally be less than about 20 grams, most preferably less than about 17 grams, and most preferably less than about 15 grams. Finally, the rear central portion 1656 in this embodiment may have a mass that is greater than about 50 grams, more preferably greater than about 55 grams, and most preferably greater than about 58 grams.

Figure 17:
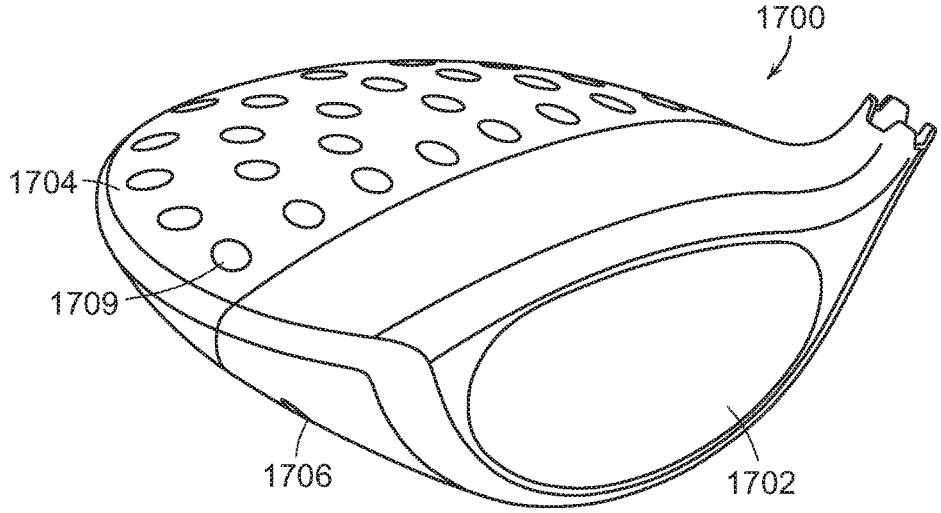
FIG. 17 of the accompanying drawings shows a perspective view of a golf club head in accordance with an alternative embodiment of the present invention.

FIG. 17 of the accompanying drawings shows a perspective view of a golf club head 1700 in accordance with an alternative embodiment of the present invention. In this alternative embodiment of the present invention, the golf club head 1700 may have a plurality of indentations 1709 shown in the crown portion 1704 of the golf club head 1700 that may correspond and highlight the plurality of cutouts (not shown) that may exist in the chassis of the golf club head 1700. Having a plurality of indentations 1709 may be preferred in this alternative embodiment as it helps highlight and improve the weight saving technology used underneath the crown portion 1704. In addition to the above, it may even alter the aerodynamics of the crown portion 1704 to further improve the performance of the golf club head 1700.

Figure 18:
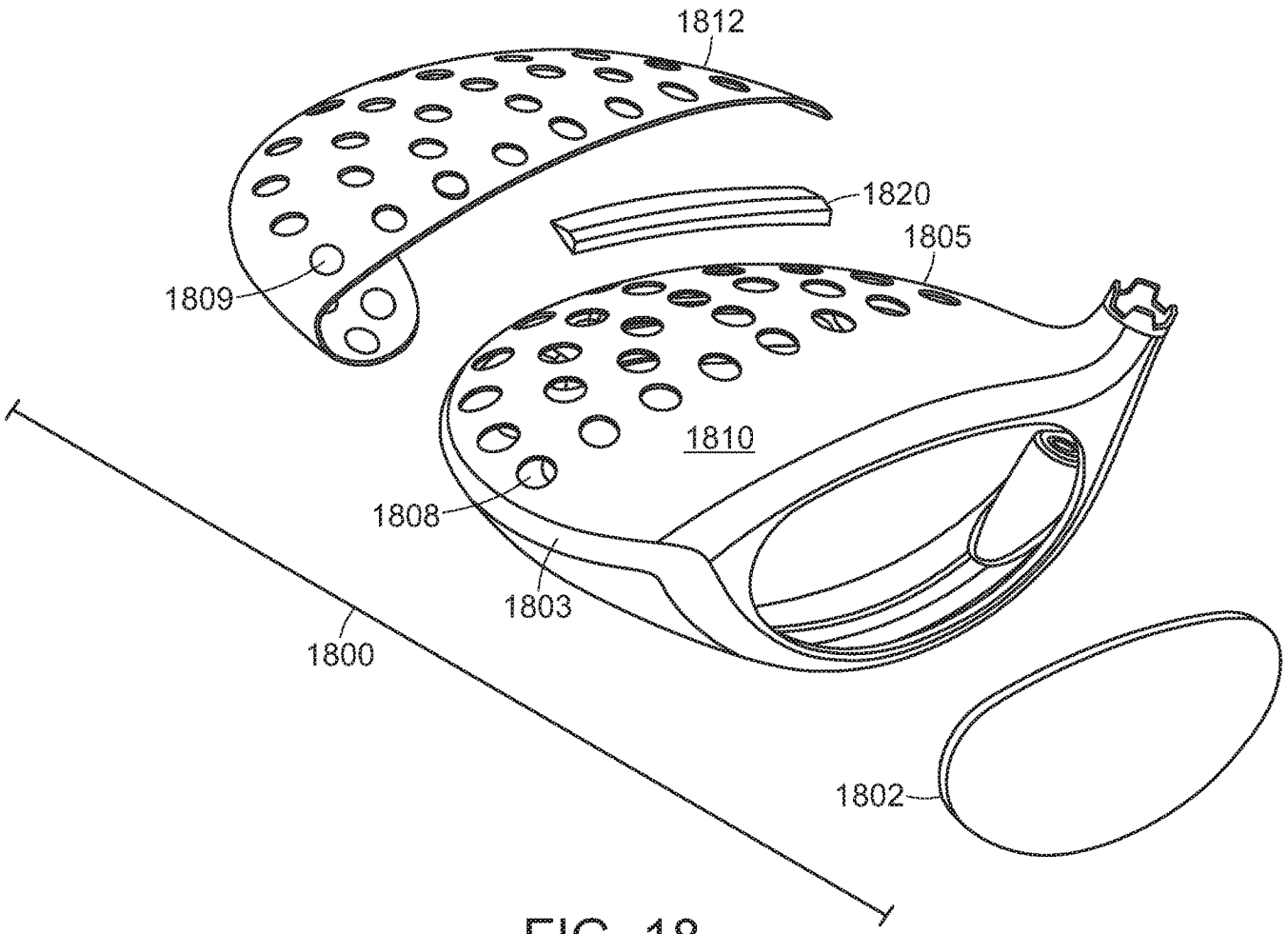
FIG. 18 of the accompanying drawings shows an exploded perspective view of a golf club head in accordance with an alternative embodiment of the present invention.

In order to illustrate the relationship between the indentations 1709 shown in FIG. 17 and the cutouts underneath, an exploded view of a golf club head 1800 in accordance with an alternative embodiment of the present invention is shown in FIG. 18. The exploded view of the golf club head 1800 allows the lightweight cover layer 1812 containing the plurality of indentation 1809 to be shown separated from the body of the golf club head 1800 wherein the body forms the base layer 1810 containing a plurality of cutouts 1808. Based on this exploded view provided in FIG. 18, it should be immediately noticeable that the lightweight cover layer 1812 may extend beyond the crown portion of the golf club head 1800 covering additional portions of the golf club head 1800. In fact, a closer examination of FIG. 18 will shows that the lightweight cover layer 1812 may wrap around a portion of the toe skirt portion 1803 of the golf club head 1800 onto a portion of the sole in this alternative embodiment without departing from the scope and content of the present invention. It should be noted here that the lightweight cover layer 1812 does not wrap around a heel skirt portion 1805 onto heel side of the sole in this alternative embodiment because the heel portion of a metalwood golf club head 1800 may have a higher probability of coming into contact with the ground, creating potential durability issues. Alternatively speaking, this type of wrap around construction can further improve the weight saving capabilities of this innovative design by allowing it to encompass more of the aft body portion of the golf club head 1800. Finally, FIG. 18 shows a mass member 1820 being exploded out from its position internally within the golf club head 1800 to further illustrate the amount of discretionary weight created by this construction resulting in an extremely large discretionary weight mass member 1820.

Figure 19:
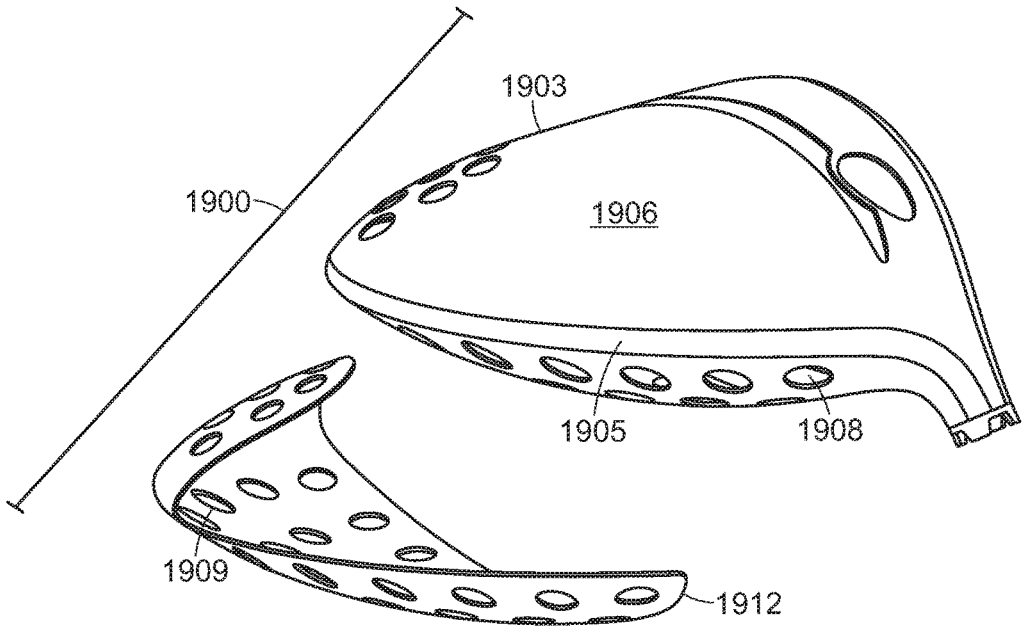
FIG. 19 of the accompanying drawings shows an exploded perspective view of a golf club head from the sole orientation in accordance with an alternative embodiment of the present invention.

FIG. 19 shows a bottom sole 1906 exploded view of a golf club head 1900 in accordance with an alternative embodiment of the present invention wherein the shape of the lightweight cover layer 1912 can be shown more clearly. In this alternative bottom view of the invention it can be seen that the lightweight cover layer 1912 may wrap around to the sole 1906 portion of the golf club head 1900 via the toe skirt portion 1803 and only on the toe portion of the golf club 1900. This embodiment may be beneficial to the performance of the golf club head 1900, as it preserves the structural integrity of the golf club head 1900 at portions that more frequently comes in contact with the ground during a golf swing. Based on this need of increased strength and durability at the potential impact locations identified above, it can be seen that the heel and central sole portion of the golf club head 1900 may also be free of any cutouts 1908 that could reduce the durability of the golf club head 1900. Alternatively speaking, it can be said that the lightweight cover layer 1912 and the plurality of cutouts 1908 do not encompass any portion of a heel portion of the sole 1906.

Figure 20:
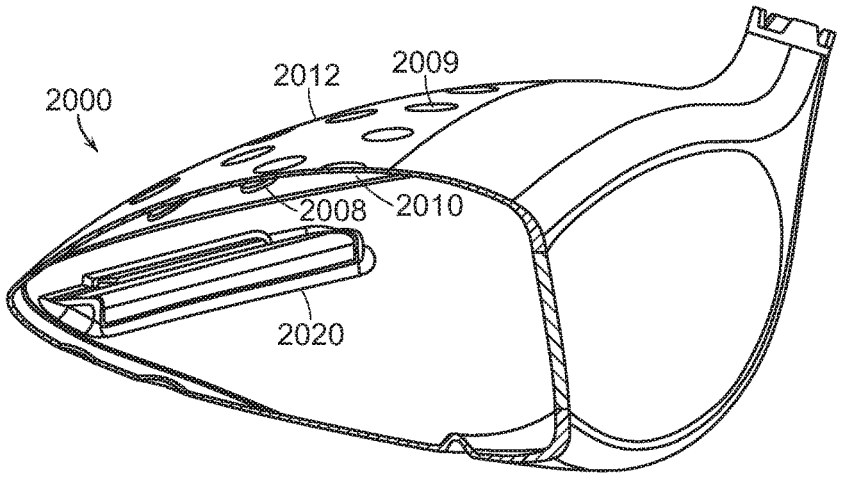
FIG. 20 of the accompanying drawings shows a partial cutout view of a golf club head in accordance with an alternative embodiment of the present invention.

FIG. 20 of the accompanying drawing shows a cut-open view of a golf club head 2000 in accordance with an alternative embodiment of the present invention. The cut-open view of the golf club head 2000 allows the location of the mass member 2020 to be shown more clearly. This mass member 2020 may generally be similar to all other previous mass members discussed earlier, and may be comprised out of a tungsten type material with a material density of greater than about 7.8 g/cc; however other types of weighting material may be used without departing from the scope and content of the present invention so long as the density of the mass member 2020 is greater than the density of the material used to create the chassis. In addition to the above, FIG. 20 also provides an additional angle to see the relationship between the lightweight cover layer 2012 containing the plurality of indentations 2009 as well as the base layer 2010 containing a plurality of cutouts 2008. More specifically, in this current embodiment of the present invention, the indentations 2009 on the lightweight cover layer 2012 correspond with the cutouts 2008 in the base layer 2010 as previously described.

Figure 21:
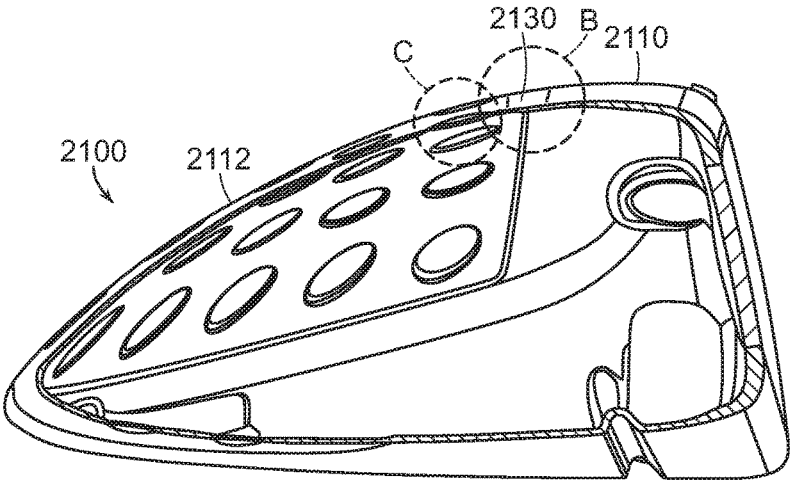
FIG. 21 of the accompanying drawings shows a cross-sectional view of a golf club head in accordance with an alternative embodiment of the present invention.

In another alternative embodiment of the present invention, the transition region between the base layer and the lightweight cover layer may not involve a stepped recess as shown previously in FIG. 4. In fact, in this alternative embodiment of the present invention, the lightweight cover layer may just sit on top of the base layer, creating a height difference near that interface. In order to address this difference in height, this alternative embodiment of the present invention utilizes a resin or a ductile material along the interface to create a smooth transition once it is polished. FIGS. 21 illustrates this interface blend by providing a cross-sectional view of a golf club head 2100 with FIG. 22 providing an enlarged cross-sectional view of the interface highlighted by circular region B.

FIG. 21 provides a cross-sectional view of a golf club head 2100 in accordance with this alternative embodiment of the present invention wherein the interface between the base layer 2110 does not contain a recessed step to receive the lightweight cover layer 2112 that was previously shown in FIG. 4. This removal of this recessed step allows the body portion of the golf club head, including the base layer 2110, to be formed similar to a traditional golf club allowing an even thinner crown portion than what would have been possible if such a step was utilized. Creating an even thinner crown is beneficial to the performance of the golf club head because any removal of weight allows more discretionary mass to be generated, providing greater flexibility in the center of gravity location of the golf club head itself. However, it should be noted that once the recessed step is removed, the lightweight cover layer 2112 now just sits on top of a smooth surface, creating a protruding step above the base layer 2110. To remedy this cosmetically unappealing feature, the current invention utilizes a blend 2130 to slowly dissipate and feather out the height difference using a resin or similar ductile material along the interface of the base layer 2110 and the lightweight cover layer 2112. In order to provide a closer look at this, an enlarged view of the interface is shown in FIG. 22, focusing on the circular region B.

It should be noted here that although the blend 2130 is shown only at the crown transition portion, it could be applicable for the sole transition portion as well in an alternative embodiment of the present invention. However, in a preferred embodiment of the present invention, the blend 2130 may only be applicable to the crown portion, leaving a step at the sole transition portion. This embodiment may generally be preferred in situations wherein the sole of the golf club head 2100 may come into contact with the ground when impacting a golf ball.

Figure 22:
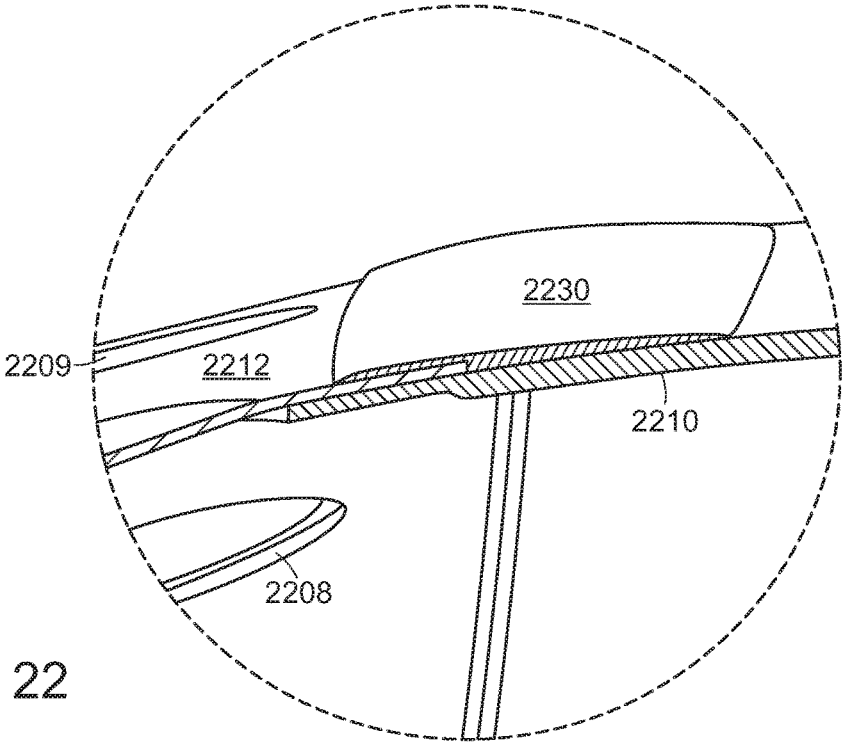
FIG. 22 of the accompanying drawings shows an enlarged cross-sectional view of a transition region of a crown of a golf club head as shown in circular region B in FIG. 21 in accordance with an alternative embodiment of the present invention.

FIG. 22 of the accompanying drawing shows an enlarged cross-sectional view of the interface between the base layer 2210 and the lightweight cover layer 2212 together with the incorporation of the blend 2230. In this enlarged cross-sectional view, it can be seen that the lightweight cover layer 2212 sits on top of the base layer 2210 at their interface, creating a step in the material thickness. To address this change in material thickness, a blend 2230 is shown. This blend 2230 may generally start with even more material than what is currently shown, and the excess material is polished away to create a smooth blend over a longer distance. This blend may generally conceal the existence of the stepped material thickness, creating an aesthetically pleasing part.

Figure 23:
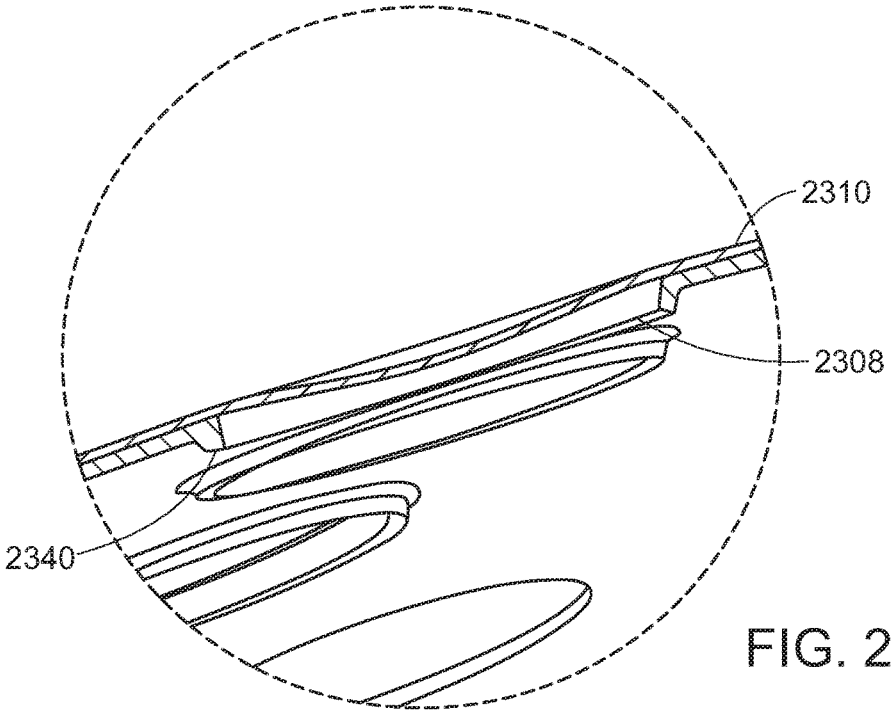
FIG. 23 of the accompanying drawings shows an enlarged cross-sectional view of circular region C shown in FIG. 21 illustrating the geometry of a cutout in accordance with an alternative embodiment of the present invention.

FIG. 23 of the accompanying drawings shows an enlarged cross-sectional view of a crown portion of the base layer 2310 as shown in circular region C in FIG. 21 in accordance with an alternative embodiment of the present invention. This enlarged cross-sectional view of the crown portion 2310 shows an additional feature of a stiffening member 2340 added around the cutouts 2308 to help increase the stiffness of the base layer 2310 around the cutouts 2308. The stiffening members 2340 shown in this embodiment of the present invention resemble a bevel; however numerous other shapes such as an actual extension leg, a beveled leg, or a round, or any other combination thereof that increases the material thickness at the cutouts 2308 without departing from the scope and content of the present invention.

Figure 24:
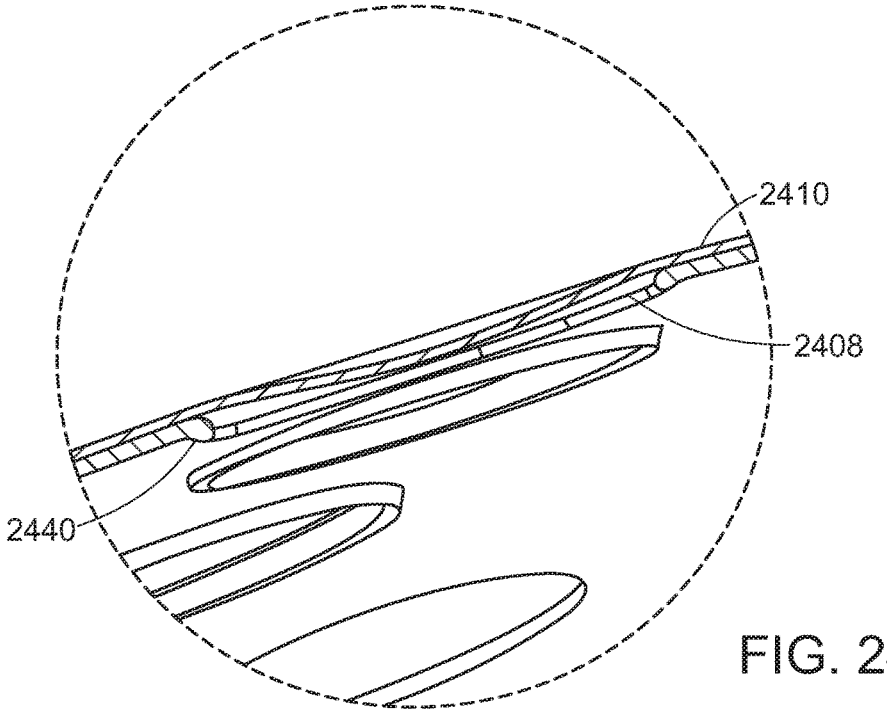
FIG. 24 of the accompanying drawings shows an enlarged cross-sectional view of circular region C shown in FIG. 21 illustrating the geometry of a cutout in accordance with a further alternative embodiment of the present invention.

FIG. 24 of the accompanying drawings shows an enlarged cross-sectional view of a crown portion of the base layer 2410 as shown in circular region C in FIG. 21 in accordance with another alternative embodiment of the present invention. This alternative embodiment utilizes a different shape to create the stiffening member 2440. The stiffening member 2440 in this embodiment of the present invention has a rounded radius around the edge of the cutouts 2408, creating a thickened portion that increases structural rigidity. It should be noted that these various geometries of stiffening members 2440 can generally be cast right into the cutouts 2408 themselves. However, in alternative embodiments of the present invention, these stiffening members 2440 may be created using a post manufacturing process without departing from the scope and content of the present invention.

Figure 25:
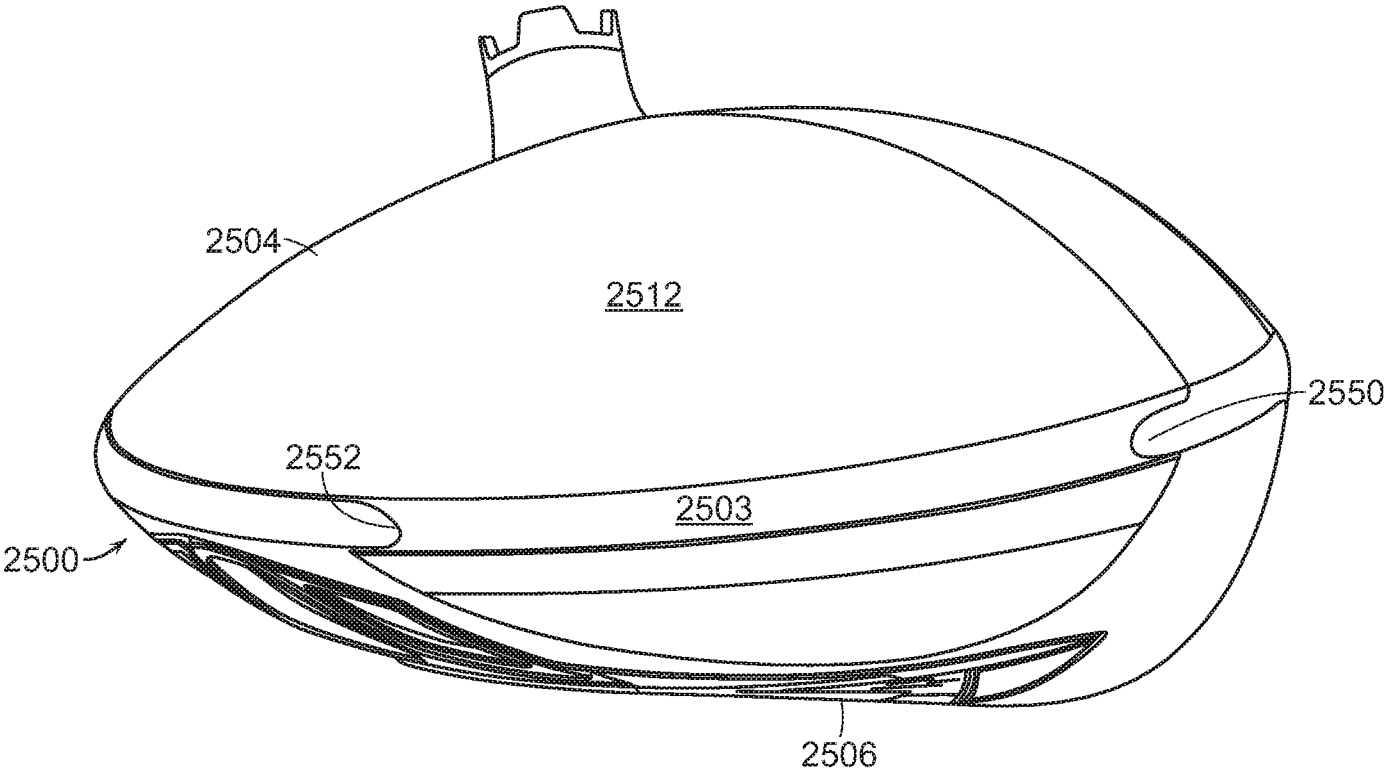
FIG. 25 of the accompanying drawings shows a perspective toe view of a golf club head in accordance with an alternative embodiment of the present invention.

FIG. 25 of the accompanying drawings shows a perspective toe side view of a golf club head 2500 in accordance with an alternative embodiment of the present invention. In this alternative embodiment of the present invention the lightweight cover layer 2512 covers the crown portion 2504 and partially covers a toe portion of the heel 2506 of the golf club head by wrapping around the skirt portion of the golf club head 2500. This type of wrap around construction for the lightweight cover layer 2512 may seem similar to the embodiments shown in FIGS. 17-19, but the lightweight cover layer 2512 do not contain a plurality of indentations as the previous embodiment. Despite the fact that no indentations are visible in this view, the plurality cutouts (not shown) in the base layer still exists in to achieve the lightweight characteristics. The elimination of the plurality of indentations allows the golf club head 2500 to preserve a more traditional look without departing from the scope and content of the present invention. In addition to not having any indentations, a closer examination of FIG. 25 will show that this embodiment differ from the previous embodiment by further incorporating notches 2550 and 2552 around the wrap around skirt portion of the lightweight cover layer 2512. More specifically, the lightweight cover layer 2512 may further comprise a frontal notch 2550 and a trailing notch 2552, with the frontal notch 2550 placed at a frontal skirt portion of the wrap around portion of the lightweight cover layer 2512 and the trailing notch 2552 placed at a rearward skirt portion of the wrap around portion of the lightweight cover layer 2512.

Having the frontal notch 2550 and the trailing notch 2552 is critical to the proper adhesion of the lightweight cover layer 2512 with the base layer (not shown) in this alternative embodiment of the present invention because it allows for minor variations in the manufacturing of the base layer and the lightweight cover layer 2512 and still allow them to mate with one another. Due to inherent manufacturing tolerances, the casting process associated with the manufacturing of the metallic portion of the golf club head 2500 that forms the base layer as well as the tolerances in creating the lightweight cover layer 2512, the bond between the two extremely large surfaces may yield minor imperfections due to the inherent manufacturing tolerances mentioned above. The present invention, in order to address some of the inherent manufacturing tolerances, have creates some flexibility in the geometry of the lightweight cover layer 2512 by utilizing a frontal notch 2550 and a trailing notch 2552. Having the frontal notch 2550 and the trailing notch 2552 near the skirt portion of the lightweight cover layer 2512 creates the flexibility needed in the lightweight cover layer 2512 to ensure a smooth bond between the lightweight cover layer 2512 and the base layer.

It should be noted here that in this alternative embodiment of the present invention the length of the frontal notch 2550 may generally be greater than the length of the trailing notch 2552 in order to ensure optimal bonding. However, in alternative embodiments of the present invention, the length of the frontal notch 2550 and the length of the trailing notch 2552 may be the same, or even shorter all without departing from the scope and content of the present invention so long as they are capable of creating the flexibility to accommodate manufacturing tolerances.

Figure 26:
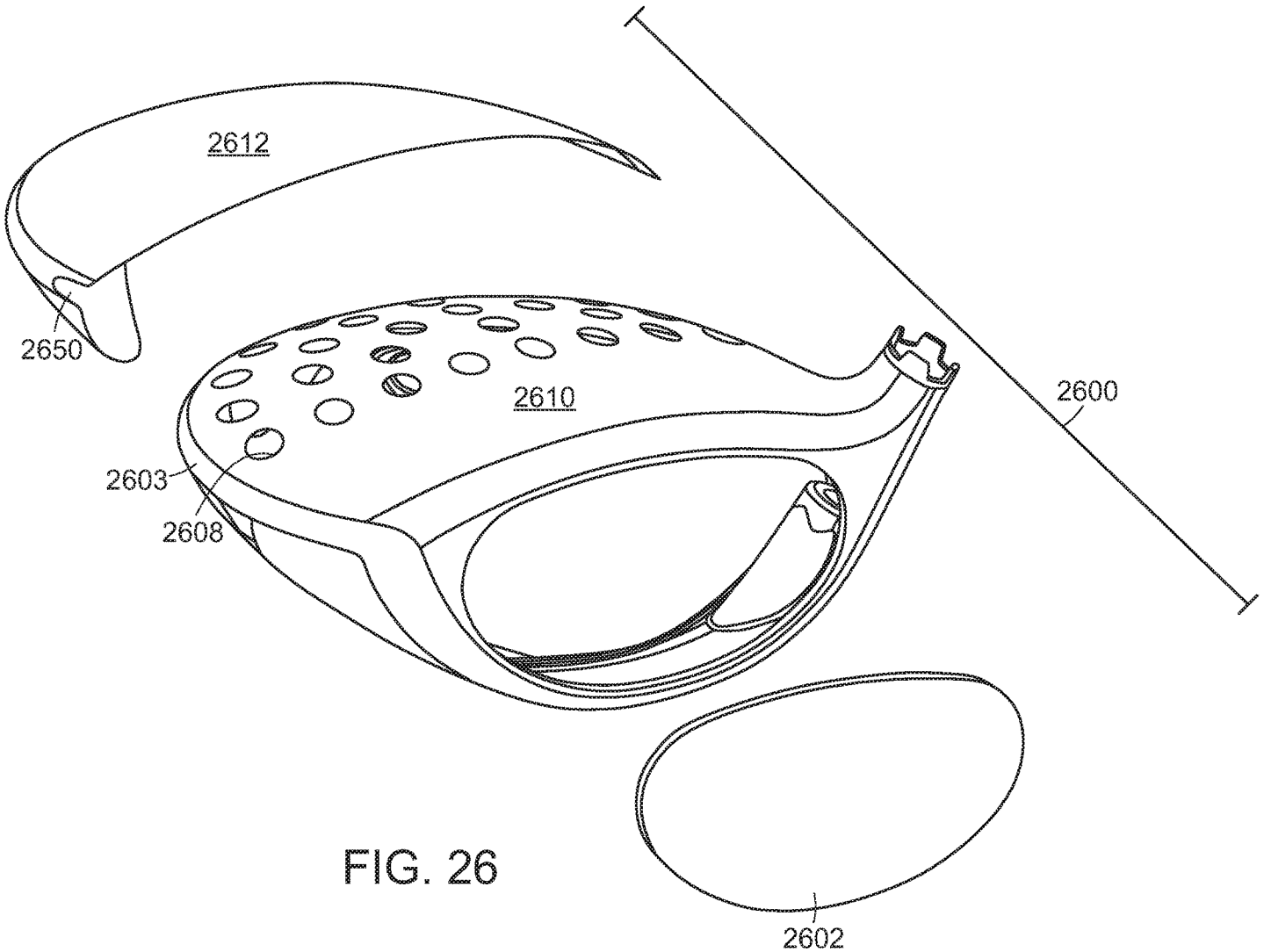
FIG. 26 of the accompanying drawing shows an exploded perspective view of a golf club head in accordance with an alternative embodiment of the present invention.

FIG. 26 shows an exploded perspective view of a golf club head 2600 in accordance with this alternative embodiment of the present invention. The exploded view, as previously indicated, allowed for the plurality of cutouts 2608 in the base layer 2610 to be shown more clearly. The plurality of cutouts 2608, like previous embodiments, may generally be created in the metallic base layer. The lightweight cover layer 2612 in this embodiment may be different from previous examples in that it no longer has the indentations to match the plurality of cutouts 2608 as earlier embodiments show. This removal of the indentations on the lightweight cover layer 2612, as previously mentioned, allows the golf club head 2600 to achieve the performance properties without sacrificing the traditional look on the crown portion of a golf club head 2600. In addition to illustrating the plurality of cutouts 2608 in the base layer 2610, FIG. 26 of the accompanying drawing also allows the frontal notch 2650 to be shown. As previously explained, the frontal notch 2650 works in conjunction with the trailing notch (not shown in FIG. 26) to allow the lightweight cover layer 2612 to mate with the base layer 2610 more closely by allowing some adjustment to the lightweight cover layer 2612 shape. The adjustments to the shape of the lightweight cover layer 2612 allows the two components to mate more closely around a curved surface without departing from the scope and content of the present invention.

Figure 27:
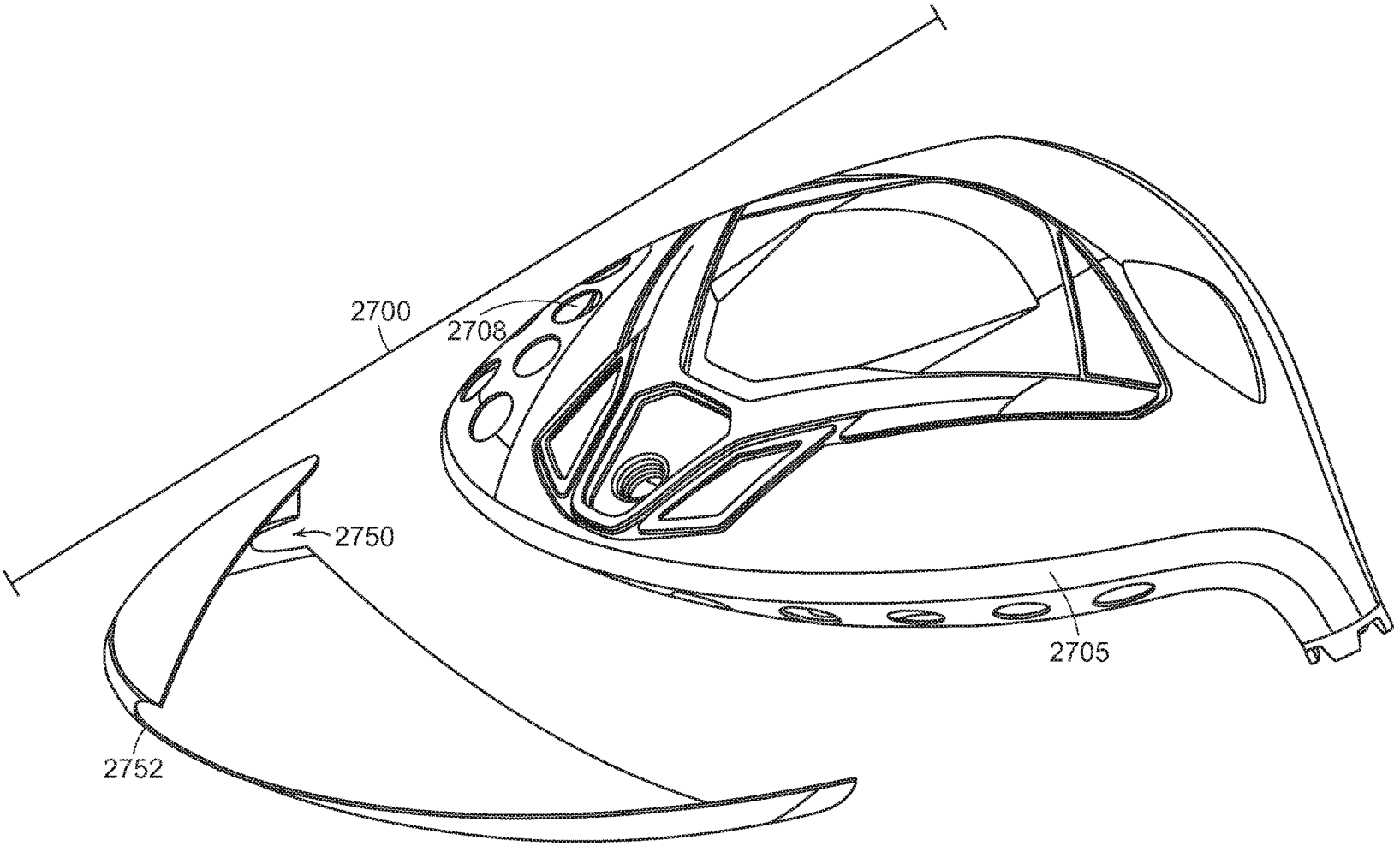
FIG. 27 of the accompanying drawings shows another exploded perspective view of a golf club head in accordance with an alternative embodiment of the present invention.

FIG. 27 of the accompanying drawings shows an exploded sole perspective view of a golf club head 2700 in accordance with this alternative embodiment of the invention. In this figure, it can be seen that the plurality of holes 2708 in the base layer only extends to the toe portion of the sole of the golf club head 2700. The lack of holes in the heel portion may help the performance of the golf club head 2700 allows better ground interface.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion located at a frontal portion of said golf club head; and a body portion attached to an aft portion of said striking face portion further comprising a crown portion and a sole portion;

wherein a portion of said body portion further comprises a base layer and a lightweight cover layer, said base layer further comprises a plurality of cutouts, and said lightweight cover layer wraps around a toe skirt portion of said golf club head, at least partially encompassing a majority of said crown and only a toe portion of said sole.

2. The golf club head of claim 1, wherein said lightweight cover layer does not encompass any portion of a heel portion of said sole.

3. The golf club head of claim 2, wherein said plurality of cutouts does not encompass any portion of said heel portion of said sole.

4. The golf club head of claim 1, wherein said lightweight cover layer further comprises at least one notch around a skirt portion of said lightweight cover layer.

5. The golf club head of claim 4, wherein said at least one notch further comprises a frontal notch and a trailing notch.

6. The golf club head of claim 5, wherein said frontal notch is longer than said trailing notch.

7. The golf club head of claim 5, wherein said frontal notch is the same length as said trailing notch.

8. The golf club head of claim 1, wherein said lightweight cover layer has an Internal Exposure Percentage of greater than about 15% and less than about 60%.

9. A golf club head comprising:

a striking face portion located at a frontal portion of said golf club head; and a body portion attached to an aft portion of said striking face portion further comprising a crown portion and a sole portion;

wherein a portion of said body portion further comprises a base layer and a lightweight cover layer, said lightweight cover layer wraps around a toe skirt portion of said golf club head, at least partially encompassing a majority of said crown and only a toe portion of said sole, and wherein said lightweight cover layer further comprises at least one notch around a skirt portion of said lightweight cover layer.

10. The golf club head of claim 9, wherein said at least one notch further comprises a frontal notch and a trailing notch.

11. The golf club head of claim 10, wherein said frontal notch is longer than said trailing notch.

12. The golf club head of claim 10, wherein said frontal notch is the same length as said trailing notch.

13. The golf club head of claim 9, wherein said lightweight cover layer has an Internal Exposure Percentage of greater than about 15% and less than about 60%.

14. The golf club head of claim 13, wherein said lightweight cover layer has an Internal Exposure Percentage of greater than about 20% and less than about 50%.

15. The golf club head of claim 14, wherein said lightweight cover layer has an Internal Exposure Percentage of greater than about 25% and less than about 45%.

16. The golf club head of claim 13, wherein said plurality of cutouts in said base layer extends around onto said toe portion of said sole of said golf club head.

17. A golf club head comprising:

a striking face portion located at a frontal portion of said golf club head; and a body portion attached to an aft portion of said striking face portion further comprising a crown portion and a sole portion;

wherein a portion of said body portion further comprises a base layer and a lightweight cover layer, said base layer further comprises a plurality of cutouts, and said lightweight cover layer wraps around a toe skirt portion of said golf club head, at least partially encompassing a majority of said crown and only a toe portion of said sole.

18. The golf club head of claim 17, wherein said base layer has a maximum thickness of less than about 0.50 mm, and said lightweight cover layer has a maximum thickness of less than about 0.30 mm.

19. The golf club head of claim 18, wherein said base layer has a maximum thickness of less than about 0.40 mm, and said lightweight cover layer has a maximum thickness of less than about 0.25 mm.

20. The golf club head of claim 19, wherein said base layer has a maximum thickness of less than about 0.35 mm, and said lightweight cover layer has a maximum thickness of less than about 0.20 mm.

* * * * *